US011827011B2

(12) United States Patent
Kishida

(10) Patent No.: US 11,827,011 B2
(45) Date of Patent: Nov. 28, 2023

(54) INKJET PRINTER THAT SUPPRESS CLOGGING OF NOZZLES OF INKJET HEAD DUE TO STRAY LIGHT

(71) Applicant: MIMAKI ENGINEERING CO., LTD., Nagano (JP)

(72) Inventor: Yutaro Kishida, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 17/611,170

(22) PCT Filed: May 14, 2020

(86) PCT No.: PCT/JP2020/019238
§ 371 (c)(1),
(2) Date: Nov. 14, 2021

(87) PCT Pub. No.: WO2020/230846
PCT Pub. Date: Nov. 19, 2020

(65) Prior Publication Data

US 2022/0250396 A1 Aug. 11, 2022

(30) Foreign Application Priority Data

May 16, 2019 (JP) ..... 2019-092542
May 16, 2019 (JP) ..... 2019-092543
Nov. 19, 2019 (JP) ..... 2019-208363

(51) Int. Cl.
*B41J 2/21* (2006.01)
*B41J 11/00* (2006.01)
*B41J 2/045* (2006.01)

(52) U.S. Cl.
CPC ..... *B41J 2/2117* (2013.01); *B41J 2/04503* (2013.01); *B41J 11/00214* (2021.01)

(58) Field of Classification Search
CPC ..... B41J 2/2117; B41J 2/04503; B41J 11/00214; B41J 2/15; B41J 2/165;
(Continued)

(56) References Cited

U.S. PATENT DOCUMENTS

2009/0219342 A1* 9/2009 Hishida ..... B41J 11/00214 347/51
2012/0120168 A1* 5/2012 Kachi ..... B41J 11/00218 347/102

FOREIGN PATENT DOCUMENTS

JP H0418356 1/1992
JP 2004188891 7/2004
(Continued)

OTHER PUBLICATIONS

"Office Action of Japan Counterpart Application", dated Jun. 22, 2022, with English translation thereof, p. 1-p. 8.
(Continued)

*Primary Examiner* — Bradley W Thies
(74) *Attorney, Agent, or Firm* — JCIPRNET

(57) ABSTRACT

An inkjet printer includes an inkjet head having multiple nozzles that eject an ultraviolet-curable ink, an ultraviolet irradiator that cures the ink, a carriage on which the inkjet head and the ultraviolet irradiator are mounted, a carriage drive mechanism that moves the carriage in a main scanning direction, and a controller that controls the ultraviolet irradiator. A part of the ultraviolet irradiator disposed at the same position as the inkjet head in a sub scanning direction is a head position ultraviolet irradiation portion. The controller makes a peak illuminance of ultraviolet with which the head position ultraviolet irradiation portion irradiates the ink when the carriage moves at a moving speed V2 lower than a peak illuminance of ultraviolet with which the head position ultraviolet irradiation portion irradiates the ink
(Continued)

when the carriage moves at a moving speed V1, where the moving speed V2 is lower than the moving speed V1.

11 Claims, 6 Drawing Sheets

(58) Field of Classification Search
CPC .... B41J 2/2114; B41J 2/2132; B41J 2202/20; B41J 11/00212; B41J 11/00218
See application file for complete search history.

(56) References Cited

FOREIGN PATENT DOCUMENTS

| | | |
|---|---|---|
| JP | 2004284141 | 10/2004 |
| JP | 2005280346 | 10/2005 |
| JP | 2005315856 | 11/2005 |
| JP | 2013188962 | 9/2013 |
| JP | 2014065287 | 4/2014 |
| JP | 2014168980 | 9/2014 |
| JP | 2014188891 | 10/2014 |
| JP | 2015051547 | 3/2015 |
| JP | 2016147500 | 8/2016 |

OTHER PUBLICATIONS

"International Search Report (Form PCT/ISA/210) of PCT/JP2020/019238," dated Jul. 28, 2020, with English translation thereof, pp. 1-11.
"Office Action of Japan Counterpart Application", dated Nov. 30, 2022, with English translation thereof, pp. 1-11.
"Office Action of Japan Counterpart Application", dated Nov. 30, 2022, with English translation thereof, pp. 1-7.

* cited by examiner

INKJET PRINTER THAT SUPPRESS CLOGGING OF NOZZLES OF INKJET HEAD DUE TO STRAY LIGHT

CROSS-REFERENCE TO RELATED APPLICATION

This application is a 371 application of the international PCT application serial no. PCT/JP2020/019238, filed on May 14, 2020, which claims the priority benefits of Japan application no. 2019-092543, filed on May 16, 2019, Japan application no. 2019-092542, filed on May 16, 2019, and Japan application no. 2019-208363, filed on Nov. 19, 2019. The entirety of each of the above-mentioned patent applications is hereby incorporated by reference herein and made a part of this specification.

TECHNICAL FIELD

The present invention relates to an inkjet printer and a control method of an inkjet printer.

BACKGROUND ART

Conventionally, an inkjet printer including an inkjet head that ejects an ultraviolet-curable ink toward a print medium, an ultraviolet irradiator that irradiates the ink adhering to the print medium with ultraviolet to cure the ink, a carriage on which the inkjet head and the ultraviolet irradiator are mounted, and a carriage drive mechanism that moves the carriage in a main scanning direction is known (for example, Patent Literatures 1 and 2).

CITATION LIST

Patent Literature

Patent Literature 1: Japanese Unexamined Patent Publication No. 2014-168980

Patent Literature 2: Japanese Unexamined Patent Publication No. 2004-284141

SUMMARY OF INVENTION

Technical Problems

Of the ultraviolet emitted from the ultraviolet irradiator, the ultraviolet reflected by the surface of a print medium or the like becomes stray light. In the inkjet printer described in Patent Literature 1, stray light reaches a nozzle (ink ejection port) of an inkjet head, so that the ink in the nozzle may be cured to cause clogging. Furthermore, in the inkjet printer described in Patent Literature 2, the ultraviolet irradiation angle is inclined to reduce stray light, but the cumulative light quantity (cumulative illuminance) of the ultraviolet with which ink is irradiated ejected onto the print medium decreases, and thus the ink is less likely to be cured.

Therefore, it cannot be said that the inkjet printers described in Patent Literatures 1 and 2 can perform appropriate printing.

Therefore, it is required to provide an inkjet printer and a control method of an inkjet printer that can perform appropriate printing.

SOLUTIONS TO PROBLEMS

The present invention is an inkjet printer including: an inkjet head provided with a plurality of nozzles that eject an ink which is ultraviolet-curable; an ultraviolet irradiator configured to irradiate the ink ejected from the inkjet head with an ultraviolet to cure the ink; a carriage on which the inkjet head and the ultraviolet irradiator are mounted; a carriage drive mechanism configured to move the carriage in a main scanning direction; and a controller configured to control the ultraviolet irradiator, in which where a direction orthogonal to the main scanning direction and an up-down direction is a sub scanning direction, a part of the ultraviolet irradiator disposed at a same position as the inkjet head in the sub scanning direction is a head position ultraviolet irradiation portion, a predetermined moving speed of the carriage in the main scanning direction is a first moving speed, and a moving speed of the carriage in the main scanning direction slower than the first moving speed is a second moving speed, the controller is configured to set a peak illuminance of ultraviolet with which the head position ultraviolet irradiation portion irradiates the ink when the carriage moves at the second moving speed to be lower than a peak illuminance of ultraviolet with which the head position ultraviolet irradiation portion irradiates the ink when the carriage moves at the first moving speed.

According to the present invention, the irradiation time of ultraviolet becomes longer when the carriage moves at the second moving speed than that when the carriage moves at the first moving speed, but the amount of ultraviolet reflected on the print medium is reduced by lowering the peak illuminance.

This can suppress the amount of ultraviolet that becomes stray light, and therefore can suppress clogging of the nozzles of the inkjet head even if the irradiation time of ultraviolet becomes long. Therefore, it is possible to provide an inkjet printer that can perform appropriate printing.

In an inkjet printer according to one aspect of the present invention, the controller is configured to change a peak illuminance of ultraviolet with which the head position ultraviolet irradiation portion irradiates the ink according to a moving speed of the carriage, so that a value obtained by dividing a peak illuminance of ultraviolet with which the head position ultraviolet irradiation portion irradiates the ink by a moving speed of the carriage becomes constant.

According to the present invention, regardless of the moving speed of the carriage, the cumulative light quantity, which is the product of the peak illuminance of ultraviolet with which the head position ultraviolet irradiation portion irradiates ink and the irradiation time of ultraviolet, can be made constant.

In an inkjet printer according to one aspect of the present invention, the controller is configured to: turn on an entirety of the head position ultraviolet irradiation portion when the carriage moves at the first moving speed, and turn off a part of the head position ultraviolet irradiation portion when the carriage moves at the second moving speed.

According to the present invention, the amount of ultraviolet that becomes stray light can be suppressed as compared with that in the case where the peak illuminance of ultraviolet to be irradiated is set to a uniform peak illuminance regardless of the moving speed of the carriage.

In an inkjet printer according to one aspect of the present invention, the ultraviolet irradiator and the inkjet head are adjacent to each other in the main scanning direction, and the controller is configured to turn off a part of the head position ultraviolet irradiation portion on a side of the inkjet head in the main scanning direction, when the carriage moves at the second moving speed.

According to the present invention, the interval between the turned on part of the head position ultraviolet irradiation portion and the inkjet head can be widened. Thus, stray light becomes less likely to reach the nozzles of the inkjet head. Therefore, clogging of the nozzle of the inkjet head due to stray light when the carriage moves at the second moving speed can be suppressed.

A control method of an inkjet printer according to one aspect of the present invention, the inkjet printer including: an inkjet head provided with a plurality of nozzles that eject an ink which is ultraviolet-curable; an ultraviolet irradiator configured to irradiate the ink ejected from the inkjet head with an ultraviolet to cure the ink; a carriage on which the inkjet head and the ultraviolet irradiator are mounted; and a carriage drive mechanism configured to move the carriage in a main scanning direction, the control method includes:

where a direction orthogonal to the main scanning direction and an up-down direction is a sub scanning direction, a part of the ultraviolet irradiator disposed at a same position as the inkjet head in the sub scanning direction is a head position ultraviolet irradiation portion, a predetermined moving speed of the carriage in the main scanning direction is a first moving speed, and a moving speed of the carriage in the main scanning direction slower than the first moving speed is a second moving speed, setting a peak illuminance of ultraviolet with which the head position ultraviolet irradiation portion irradiates the ink when the carriage moves at the second moving speed to be lower than a peak illuminance of ultraviolet with which the head position ultraviolet irradiation portion irradiates the ink when the carriage moves at the first moving speed.

According to the present invention, the irradiation time of ultraviolet becomes longer when the carriage moves at the second moving speed than that when the carriage moves at the first moving speed, but the amount of ultraviolet reflected on the print medium is reduced by lowering the peak illuminance.

This can suppress the amount of ultraviolet that becomes stray light, and therefore can suppress clogging of the nozzles of the inkjet head even if the irradiation time of ultraviolet becomes long. Therefore, it is possible to provide a control method of an inkjet printer that can perform appropriate printing.

The present invention is an inkjet printer including: an inkjet head provided with a plurality of nozzle rows that eject an ink which is ultraviolet-curable; an ultraviolet irradiator configured to irradiate the ink ejected from the inkjet head with an ultraviolet to cure the ink; a carriage on which the inkjet head and the ultraviolet irradiator are mounted; and a carriage drive mechanism configured to move the carriage in a main scanning direction, in which the inkjet head and the ultraviolet irradiator are adjacent to each other in the main scanning direction, the nozzle rows include a plurality of nozzles arranged in a sub scanning direction orthogonal to the main scanning direction and an up-down direction, the inkjet head includes: a color ink nozzle row, being the nozzle row that ejects a color ink which is ultraviolet-curable; a white ink nozzle row, being the nozzle row that ejects a white ink which is ultraviolet-curable; and a clear ink nozzle row, being the nozzle row that ejects a clear ink which is ultraviolet-curable and transparent, the white ink nozzle row and the clear ink nozzle row are disposed at a same position in the sub scanning direction, the color ink nozzle row is disposed at a position shifted from the white ink nozzle row and the clear ink nozzle row in the sub scanning direction, and at least the color ink nozzle row or the white ink nozzle row is arranged between the clear ink nozzle row and the ultraviolet irradiator in the main scanning direction.

According to the present invention, the interval in the right-left direction between the clear ink nozzle row and the ultraviolet irradiator is widened by the arrangement of the color ink nozzle row or the white ink nozzle row.

Therefore, stray light is less likely to reach the clear ink nozzle row even if the ultraviolet is irradiated from the ultraviolet irradiator, and thus it is possible to provide an inkjet printer that can suppress the nozzles of the clear ink nozzle row from clogging due to the influence of the stray light, and can perform appropriate printing.

The color ink nozzle row becomes continuous in the front-back direction with respect to the white ink nozzle row and the clear ink nozzle row. Therefore, even if multi-pass printing is performed, the undercoat or the overcoat can be continuously applied to the color ink, so that deterioration of the printing quality due to generation of streak-like unevenness can be prevented.

In an inkjet printer according to one aspect of the present invention, the ultraviolet irradiator is arranged on each of both sides of the inkjet head in the main scanning direction.

According to the present invention, the interval in the right-left direction between the two ultraviolet irradiators and the clear ink nozzle row can be widened. Therefore, even if ultraviolet is irradiated from either the left or right ultraviolet irradiator, stray light is less likely to reach the clear ink nozzle row, and it becomes therefore possible to suppress the nozzles of the clear ink nozzle row from clogging due to the influence of stray light.

In an inkjet printer according to one aspect of the present invention, the white ink nozzle row and the clear ink nozzle row are arranged adjacent to each other in the main scanning direction, and the color ink nozzle row is arranged on each of both sides in the main scanning direction of the white ink nozzle row and the clear ink nozzle row.

According to the present invention, the interval in the right-left direction between the clear ink nozzle row and the ultraviolet irradiator is further widened by the arrangement of the color ink nozzle row and the white ink nozzle row.

Therefore, stray light is less likely to reach the clear ink nozzle row even if ultraviolet is irradiated from the ultraviolet irradiator, and thus it is possible to more effectively suppress the nozzles of the clear ink nozzle row from clogging due to the influence of the stray light.

In an inkjet printer according to one aspect of the present invention, the inkjet head includes: a first inkjet head provided with a plurality of the color ink nozzle rows, and a second inkjet head provided with the white ink nozzle row and the clear ink nozzle row.

According to the present invention, the configuration of the inkjet head can be simplified as compared with the case where the inkjet head in which the white ink nozzle row is formed and the inkjet head in which the clear ink nozzle row is formed are separately provided.

The present invention is an inkjet printer including: an inkjet head provided with a plurality of nozzles that eject an ink which is ultraviolet-curable toward a print medium; an ultraviolet irradiator configured to irradiate the print medium with an ultraviolet to cure the ink ejected from the inkjet head onto the print medium; a carriage on which the inkjet head and the ultraviolet irradiator are mounted; and a carriage drive mechanism configured to reciprocate the carriage in a main scanning direction, in which a cumulative light quantity of ultraviolet with which the ultraviolet irradiator irradiates the print medium during one reciprocating operation of the carriage is adjustable according to reflectance of the print medium.

According to the present invention, for example, when printing is performed on a print medium having a high reflectance, the amount of ultraviolet reflected on the print medium to become stray light can be reduced by reducing the cumulative light quantity of the ultraviolet with which the ultraviolet irradiator irradiates the print medium. Then, the cumulative light quantity of the ultraviolet reaching the inkjet head is reduced, so that it is possible to provide the inkjet printer that can suppress clogging of the nozzles of the inkjet head.

An inkjet printer according to one aspect of the present invention further includes:

a reflectance detection mechanism configured for detecting reflectance of the print medium, and a controller configured to control the inkjet printer, in which the controller is configured to: detect reflectance of the print medium using the reflectance detection mechanism before printing the print medium, and change a cumulative light quantity of ultraviolet with which the ultraviolet irradiator irradiates the print medium during one reciprocating operation of the carriage based on reflectance of the print medium having been detected.

According to the present invention, it is possible to estimate the amount of ultraviolet that becomes stray light based on the detected reflectance to automatically adjust the cumulative light quantity of the ultraviolet with which the ultraviolet irradiator irradiates the print medium.

In an inkjet printer according to one aspect of the present invention, the reflectance detection mechanism is an optical sensor configured to detect a width of the print medium in the main scanning direction, the optical sensor is mounted on the carriage, and the controller is configured to: detect a width of the print medium in the main scanning direction using the optical sensor before printing the print medium, and change a cumulative light quantity of ultraviolet with which the ultraviolet irradiator irradiates the print medium during one reciprocating operation of the carriage based on a width of the print medium in the main scanning direction and reflectance of the print medium that have been detected.

According to the present invention, the irradiation time of ultraviolet when the carriage moves in the main scanning direction is known, and hence the amount of ultraviolet that becomes stray light can be estimated with higher accuracy than that when estimated based on only the reflectance.

In an inkjet printer according to one aspect of the present invention, the controller is configured to change a cumulative light quantity of ultraviolet with which the ultraviolet irradiator irradiates the print medium during one reciprocating operation of the carriage by changing illuminance of ultraviolet with which the ultraviolet irradiator irradiates the print medium.

According to the present invention, it is possible to change the cumulative light quantity while avoiding the resolution from changing.

In an inkjet printer according to one aspect of the present invention, the ultraviolet irradiator is PWM-controlled, and the controller is configured to change illuminance of ultraviolet with which the print medium is irradiated by changing an effective voltage applied to an entirety of the ultraviolet irradiator or a part of the ultraviolet irradiator.

According to the present invention, the cumulative light quantity of the ultraviolet reaching the nozzle of the inkjet head can be changed.

In an inkjet printer according to one aspect of the present invention, the ultraviolet irradiator and the inkjet head are adjacent to each other in the main scanning direction, and the controller is configured to lower an effective voltage applied to a part of the ultraviolet irradiator on a side of the inkjet head in the main scanning direction, when lowering illuminance of ultraviolet with which the print medium is irradiated.

According to the present invention, the cumulative light quantity of the ultraviolet reaching the inkjet head can be reduced as compared with that in the case of lowering the illuminance of a part other than a part of the ultraviolet irradiator, for example, on the inkjet head side in the main scanning direction.

A control method of an inkjet printer according to one aspect of the present invention is a control method of an inkjet printer, the inkjet printer including:

an inkjet head provided with a plurality of nozzles that eject an ink which is ultraviolet-curable toward a print medium; an ultraviolet irradiator configured to irradiate the print medium with an ultraviolet to cure the ink ejected from the inkjet head onto the print medium; a carriage on which the inkjet head and the ultraviolet irradiator are mounted; a carriage drive mechanism configured to reciprocate the carriage in a main scanning direction; and a reflectance detection mechanism configured for detecting reflectance of the print medium, the control method including:

detecting reflectance of the print medium using the reflectance detection mechanism before printing of the print medium; and changing a cumulative light quantity of ultraviolet with which the ultraviolet irradiator irradiates the print medium during one reciprocating operation of the carriage based on reflectance of the print medium having been detected.

According to the present invention, it is possible to provide a control method of an inkjet printer that can estimate the amount of ultraviolet that becomes stray light based on the detected reflectance to automatically adjust the cumulative light quantity of the ultraviolet with which the ultraviolet irradiator irradiates the print medium.

Effect of the Invention

According to the present invention, it is possible to provide an inkjet printer and a control method of an inkjet printer that can perform appropriate printing.

DESCRIPTION OF EMBODIMENTS

Figure 1:
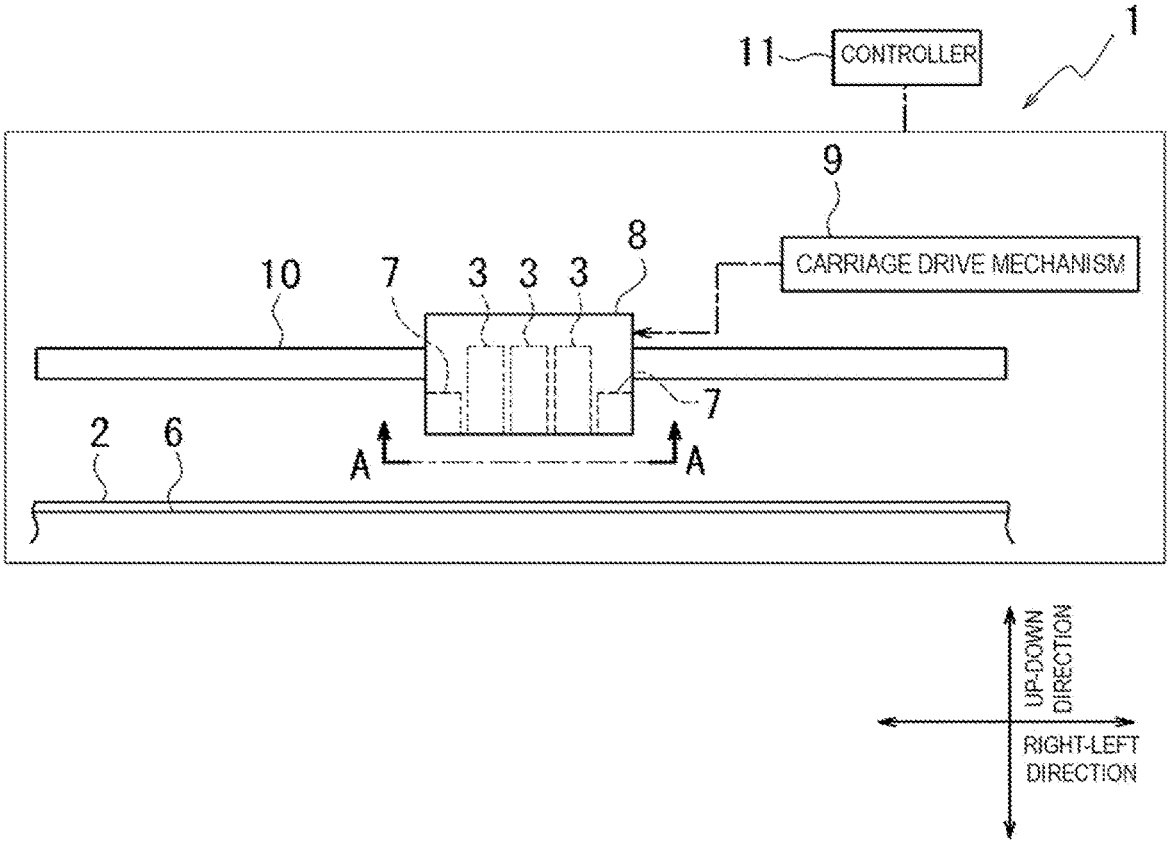
FIG. 1 is a view for explaining an inkjet printer according to the present embodiment.

An embodiment of the present invention will be described below with reference to the drawings.

In the drawings, the up-down direction means up and down in the vertical direction with respect to the installed inkjet printer. In the drawings, the front-back direction means front and rear when the inkjet printer is viewed from the front with respect to the installed inkjet printer. In the drawings, the right-left direction means right and left when the inkjet printer is viewed from the front with respect to the installed inkjet printer.

FIG. 1 is a view explaining an inkjet printer 1 according to the present embodiment.

Figure 2:
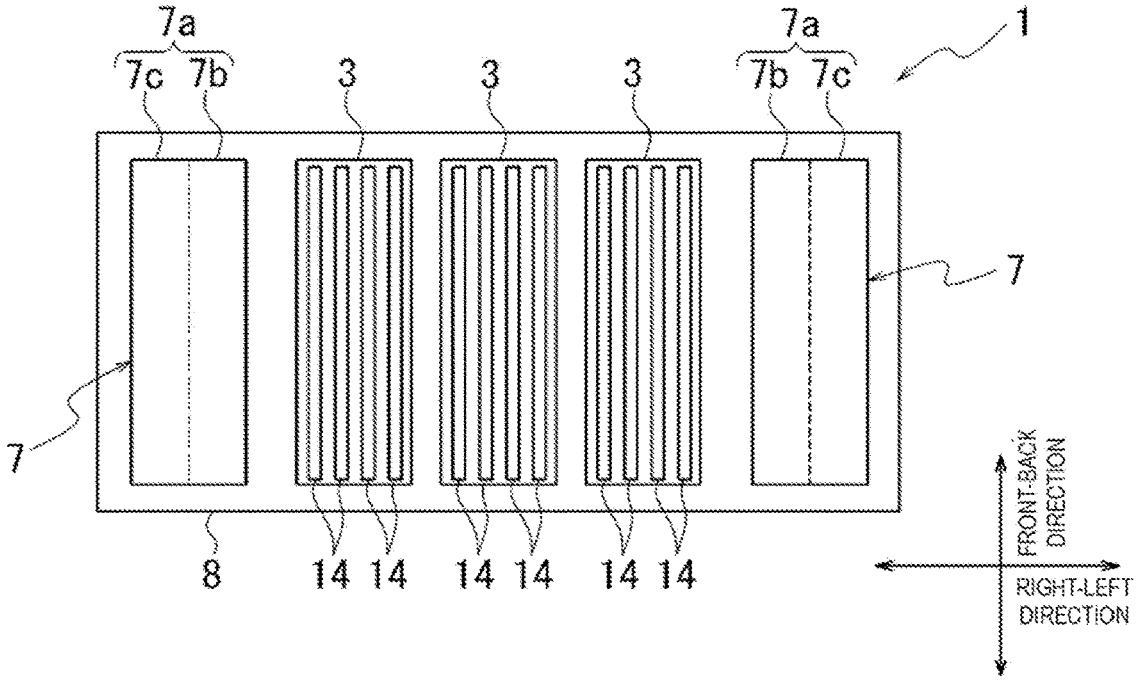
FIG. 2 is a view for explaining the inkjet printer according to the present embodiment.

FIG. 2 is a view of a carriage 8 in FIG. 1 as viewed from the direction of the arrow A-A.

The inkjet printer 1 (hereinafter, it is also referred to as a "printer 1".) according to the present embodiment is, for example, a business-use inkjet printer, and performs printing on a print medium 2. The print medium 2 is, for example, a printing paper, a fabric, a resin film, or the like. The printer 1 includes an inkjet head 3 that ejects ink. As the ink, an ultraviolet-curable ink (UV ink) is used.

Although a case in which the printer 1 according to the present embodiment includes three inkjet heads 3 will be explained, the printer 1 is not limited to this.

As shown in FIG. 1, the printer 1 includes a table 6 on which the print medium 2 is placed, an ultraviolet irradiator 7 that irradiates ink ejected from the inkjet head 3 with ultraviolet to cure ink, the carriage 8 on which the inkjet head 3 and the ultraviolet irradiator 7 are mounted, a carriage drive mechanism 9 that moves the carriage 8 in the main scanning direction (right-left direction in FIG. 1), and a guide rail 10 that guides the carriage 8 in the main scanning direction. The printer 1 further includes a Y bar (not illustrated) to which the guide rail 10 is fixed, and a Y bar moving mechanism (not illustrated) that moves the Y bar in the sub scanning direction (front-back direction in FIG. 2) orthogonal to the main scanning direction. The printer 1 further includes a controller 11 that controls printing by the printer 1.

In the following explanation, the main scanning direction is referred to as the "right-left direction", and the sub scanning direction is referred to as the "front-back direction". Note that the printer 1 may include a table moving mechanism that moves the table 6 in the front-back direction instead of the Y bar moving mechanism. Furthermore, instead of the Y bar moving mechanism and the table 6, the printer 1 may include a platen on which the print medium 2 at the time of printing is placed and a medium feeding mechanism that feeds the print medium 2 in the front-back direction.

The guide rail 10 traverses the table 6 in the right-left direction above the table 6 in the up-down direction. The carriage 8 reciprocates in the right-left direction on the guide rail 10 by the drive force of the carriage drive mechanism 9. Although not illustrated, the carriage drive mechanism 9 includes, for example, two pulleys, a belt bridged over the two pulleys and partly fixed to the carriage 8, and a motor that rotates the pulleys.

The three inkjet heads 3 are mounted on the carriage 8 so as to be adjacent to each other in the right-left direction. The inkjet head 3 ejects ink toward the print medium 2 placed on the table 6.

As shown in FIGS. 1 and 2, a plurality of nozzle rows 14 for ejecting ink are formed on a surface of the inkjet head 3 facing the print medium 2 in the up-down direction. The nozzle rows 14 include a plurality of nozzles arranged in the front-back direction. The nozzle rows 14 are arranged at intervals in the right-left direction. The inkjet head 3 includes a piezoelectric element that ejects ink from the nozzle rows 14.

The carriage 8 includes two ultraviolet irradiators 7 and 7. The ultraviolet irradiator 7 is arranged on each of one side and the other side across the plurality of inkjet heads 3 in the right-left direction. The ultraviolet irradiator 7 and the inkjet heads 3 are adjacent to each other in the right-left direction. The width of the ultraviolet irradiator 7 in the front-back direction is equal to the width of the inkjet head 3 in the front-back direction. The ultraviolet irradiator 7 is disposed at the same position as the inkjet head 3 in the front-back direction.

As shown in FIGS. 1 and 2, the ultraviolet irradiator 7 irradiates ultraviolet from a head position ultraviolet irradiation portion 7*a*, which faces the print medium 2 in the up-down direction of the ultraviolet irradiator 7.

The ultraviolet irradiator 7 includes, for example, a plurality of light emitting elements and a substrate on which the plurality of light emitting elements are mounted. The light emitting elements are, for example, UV LED chips that emit ultraviolet. The substrate is formed in, for example, a rectangular shape with the front-back direction as the long side direction.

The head position ultraviolet irradiation portion 7*a* of the ultraviolet irradiator 7 is partitioned into irradiation portions 7*b* and 7*c* adjacent in the right-left direction. The irradiation portion 7*b* and the irradiation portion 7*c* can be individually controlled to be turned on. In the head position ultraviolet irradiation portion 7*a*, the irradiation portion 7*b* and the irradiation portion 7*c* are individually controlled to be turned on by the controller 11.

As shown in FIG. 2, the irradiation portion 7*b* is disposed on the inkjet head 3 side in the right-left direction. That is, in the ultraviolet irradiator 7 disposed on the right side, the irradiation portion 7*b* is disposed on the left side, and the irradiation portion 7*c* is disposed on the right side. In the ultraviolet irradiator 7 disposed on the left side, the irradiation portion 7*b* is disposed on the right side, and the irradiation portion 7*c* is disposed on the left side. The width of the irradiation portion 7*b* in the right-left direction is equal to the width of the irradiation portion 7*c* in the right-left direction. The width of the irradiation portion 7*b* in the right-left direction and the width of the irradiation portion 7*c* in the right-left direction may be different from each other. For example, the width of the irradiation portion 7*c* in the right-left direction may be larger than the width of the irradiation portion 7*b* in the right-left direction.

The moving speed of the carriage 8 in the right-left direction (main scanning direction) can be changed according to the drive frequency of the piezoelectric element of the inkjet head 3 and the resolution of the image to be printed on the print medium 2. For example, when the drive frequency of the piezoelectric element is constant and a high resolution is required for the image to be printed on the print medium 2, the controller 11 slows the moving speed of the carriage 8. On the other hand, when a high resolution is not required for the image to be printed on the print medium 2, the controller 11 increases the moving speed of the carriage 8 to shorten the printing time.

In the present embodiment, the controller 11 moves the carriage 8 in the right-left direction at either of the following speeds according to the print content.

(i) When short-time printing is desired, the controller 11 moves the carriage 8 at a first moving speed (moving speed V1).

(ii) When high-resolution printing is desired, the controller 11 moves the carriage 8 at a second moving speed (moving speed V2). The moving speed V2 is set to a speed slower than the moving speed V1.

The controller 11 increases the peak illuminance of ultraviolet irradiated from the head position ultraviolet irradiation portion 7*a* when the moving speed of the carriage 8 increases, and decreases the peak illuminance of ultraviolet irradiated from the head position ultraviolet irradiation portion 7*a* when the moving speed of the carriage 8 decreases.

That is, the controller 11 sets the peak illuminance of ultraviolet irradiated from the head position ultraviolet irradiation portion 7*a* when moving the carriage 8 at the moving speed V2 to be lower than the peak illuminance of ultraviolet irradiated from the head position ultraviolet irradiation portion 7*a* when moving the carriage 8 at the moving speed V1.

On the other hand, the controller 11 sets the peak illuminance of ultraviolet irradiated from the head position ultraviolet irradiation portion 7*a* when moving the carriage 8 at the moving speed V1 to be higher than the peak illuminance of ultraviolet irradiated from the head position ultraviolet irradiation portion 7*a* when moving the carriage 8 at the moving speed V2.

In the following explanation, a case where the peak illuminance is lowered will be described by way of example.

Specifically, the controller 11 turns on the entire head position ultraviolet irradiation portion 7*a* (that is, the entire ultraviolet irradiator 7) when the carriage 8 moves at the moving speed V1, and turns off a part of the head position ultraviolet irradiation portion 7*a* when the carriage 8 moves at the moving speed V2. In this manner, the peak illuminance with which the ink is irradiated is switched. More specifically, the controller 11 turns on the entire head position ultraviolet irradiation portion 7*a* (both irradiation portions 7*b* and 7*c*) when the carriage 8 moves at the moving speed V1. When the carriage 8 moves at the moving speed V2, the controller 11 turns on only the irradiation portion 7*c* of the head position ultraviolet irradiation portion 7*a* and turns off the irradiation portion 7*b*, which is a part on the inkjet head 3 side.

The controller 11 changes, according to the moving speed of the carriage 8, the peak illuminance of ultraviolet with which the head position ultraviolet irradiation portion 7*a* irradiates ink so that the value obtained by dividing the peak illuminance of ultraviolet with which the head position ultraviolet irradiation portion 7*a* irradiates ink by the moving speed of the carriage 8 becomes constant.

The controller 11 is set so that a value obtained by dividing the peak illuminance of ultraviolet irradiated from the entire head position ultraviolet irradiation portion 7*a* (both irradiation portions 7*b* and 7*c*) when the carriage 8 moves at the moving speed V1 by the moving speed V1 and a value obtained by dividing the peak illuminance of ultraviolet irradiated from the head position ultraviolet irradiation portion 7*a* (irradiation portion 7*c*) when the carriage 8 moves at the moving speed V2 by the moving speed V2 become equal.

The controller 11 is set so that for example, in a case where the moving speed V2 is set to be a speed half of the moving speed V1, the peak illuminance of ultraviolet irradiated from the head position ultraviolet irradiation portion 7*a* (irradiation portion 7*c*) when the carriage 8 moves at the moving speed V2 is set to be an illuminance half of the peak illuminance of ultraviolet irradiated from the entire head position ultraviolet irradiation portion 7*a* when the carriage 8 moves at the moving speed V1.

Thus, the ink on the print medium 2 is irradiated with ultraviolet from the head position ultraviolet irradiation portion 7*a* so that the cumulative light quantity (cumulative illuminance), which is the product of the peak illuminance of ultraviolet and the irradiation time, becomes constant.

(Effects)

Here, the ultraviolet irradiated from the ultraviolet irradiator 7 and reflected on the surface of the print medium 2 and the like is scattered in the space between the inkjet head 3 and the print medium 2 and becomes stray light. When stray light reaches the nozzles of the inkjet head 3, the ink in the nozzles is cured, and clogging of the nozzles occurs.

The amount of ultraviolet that becomes stray light increases as the peak illuminance increases. Furthermore, the amount of ultraviolet that becomes stray light increases as the time of irradiating the print medium 2 is longer (printing time is longer). Furthermore, the narrower the interval between the lighted on part of the ultraviolet irradiator 7 and the inkjet head 3 in the right-left direction is, the more easily stray light reaches the nozzles of the inkjet head 3.

When a high-resolution image is printed, the carriage 8 moves at the moving speed V2. Then, compared with that when the carriage 8 moves at the moving speed V1, the printing time becomes longer, so that the time during which the print medium 2 is irradiated with ultraviolet also becomes longer.

When the carriage 8 moves at the moving speed V2, the controller 11 turns on the irradiation portion 7*c* of the head position ultraviolet irradiation portion 7*a* and turns off the irradiation portion 7*b*, thereby making the peak illuminance at the moving speed V2 lower than the peak illuminance at the moving speed V1.

Thus, even if the time during which the print medium 2 is irradiated with ultraviolet becomes long, the amount of ultraviolet that becomes stray light can be suppressed, and thus clogging of the nozzles of the inkjet head 3 can be suppressed.

When the carriage 8 moves at the moving speed V2, the controller 11 turns on the irradiation portion 7*c* of the head position ultraviolet irradiation portion 7*a* and turns off the irradiation portion 7*b*. Therefore, the interval in the right-left direction between the turned on part of the head position ultraviolet irradiation portion 7*a* and the inkjet head 3 becomes the interval between the irradiation portion 7*c* and the inkjet head 3. This interval is wider than the interval between the irradiation portion 7*b* and the inkjet head 3. Thus, stray light becomes less likely to reach the nozzles of the inkjet head 3. Therefore, it becomes possible to effectively suppress clogging of the nozzles of the inkjet head 3 due to stray light when the carriage 8 moves at the moving speed V2.

On the other hand, when shortening the printing time, the carriage 8 moves at the moving speed V1. In this case, since both the irradiation portions 7*b* and 7*c* are turned on in the head position ultraviolet irradiation portion 7*a*, the peak illuminance becomes higher than that when the carriage 8 moves at the moving speed V2, but the speed is high. Therefore, the time (printing time) during which the print medium 2 is irradiated with ultraviolet is short. Therefore, even if the peak illuminance at which the print medium 2 is irradiated with ultraviolet becomes high, the amount of ultraviolet that becomes stray light can be suppressed, and thus the clogging of the nozzles of the inkjet head 3 can be suppressed.

The controller 11 changes, according to the moving speed of the carriage 8, the peak illuminance of ultraviolet with which the head position ultraviolet irradiation portion 7*a* irradiates ink so that the cumulative light quantity, which is the product of the peak illuminance of ultraviolet with which the head position ultraviolet irradiation portion 7*a* irradiates ink and the irradiation time of ultraviolet with which the head position ultraviolet irradiation portion 7*a* irradiates ink, becomes constant. Therefore, even if the peak illuminance of ultraviolet with which the head position ultraviolet irradiation portion 7*a* irradiates ink is lowered according to the moving speed of the carriage 8, the cumulative light quantity of the ultraviolet with which ink is irradiated can be made constant.

As described above, the inkjet printer 1 according to the present embodiment has the following configuration.

(1) The inkjet printer 1 includes:

the inkjet head 3 in which the plurality of nozzles that eject an ultraviolet-curable ink are formed; the ultraviolet irradiator 7 that irradiates ink ejected from the inkjet head 3 with ultraviolet to cure the ink; the carriage 8 on which the inkjet head 3 and the ultraviolet irradiator 7 are mounted; the carriage drive mechanism 9 that moves the carriage 8 in the right-left direction (main scanning direction); and the controller 11 that controls the ultraviolet irradiator 7.

The direction orthogonal to the right-left direction and the up-down direction is defined as the front-back direction (sub scanning direction).

A part of the ultraviolet irradiator 7 that is disposed at the same position as the inkjet head 3 in the front-back direction is defined as the head position ultraviolet irradiation portion 7*a*.

A predetermined moving speed V1 of the carriage 8 in the right-left direction is defined as the first moving speed, and the moving speed V2 slower than the moving speed V1 of the carriage 8 in the right-left direction is defined as the second moving speed.

The controller 11 makes the peak illuminance of ultraviolet with which the head position ultraviolet irradiation portion 7*a* irradiates ink when the carriage 8 moves at the moving speed V2 lower than the peak illuminance of ultraviolet with which the head position ultraviolet irradiation portion 7*a* irradiates ink when the carriage 8 moves at the moving speed V1.

When the carriage 8 moves at the moving speed V2 in order to print a high-resolution image, the time during which the print medium 2 is irradiated with ultraviolet becomes longer than that when the carriage 8 moves at the moving speed V1.

Therefore, with the above configuration, even if the time during which the print medium 2 is irradiated with ultraviolet becomes long, the amount of ultraviolet reflected on the print medium 2 is reduced by lowering the peak illuminance. This makes it possible to suppress the amount of ultraviolet that becomes stray light, and therefore it becomes possible to suppress clogging of the nozzles of the inkjet head 3 due to stray light. Therefore, it is possible to provide the printer 1 that can perform appropriate printing.

The inkjet printer 1 according to the present embodiment has the following configuration.

(2) The controller 11 changes, according to the moving speed of the carriage 8, the peak illuminance of ultraviolet with which the head position ultraviolet irradiation portion 7*a* irradiates ink so that the value obtained by dividing the peak illuminance of ultraviolet with which the head position ultraviolet irradiation portion 7*a* irradiates ink by the moving speed of the carriage 8 becomes constant.

With this configuration, the cumulative light quantity (cumulative illuminance), which is the product of the peak illuminance of ultraviolet with which the head position ultraviolet irradiation portion 7*a* irradiates ink and the irradiation time of ultraviolet, can be made constant regardless of the moving speed of the carriage 8.

The inkjet printer 1 according to the present embodiment has the following configuration.

(3) The controller 11 turns on the entire head position ultraviolet irradiation portion 7*a* (both irradiation portions 7*b* and 7*c*) when the carriage 8 moves at the moving speed V1, and turns off the irradiation portion 7*b*, which is a part of the head position ultraviolet irradiation portion 7*a*, when the carriage 8 moves at the moving speed V2.

With this configuration, the amount of ultraviolet that becomes stray light can be suppressed as compared with that in the case where the peak illuminance of ultraviolet to be irradiated is set to a uniform peak illuminance regardless of the moving speeds V1 and V2 of the carriage 8.

The inkjet printer 1 according to the present embodiment has the following configuration.

(4) The ultraviolet irradiator 7 and the inkjet heads 3 are adjacent to each other in the right-left direction.

When the carriage 8 moves at the moving speed V2, the controller 11 turns off the irradiation portion 7*b*, which is a part of the head position ultraviolet irradiation portion 7*a* on the inkjet head 3 side in the right-left direction.

With this configuration, only the irradiation portion 7*c* is turned on, and thus the interval in the right-left direction between the turned on part of the head position ultraviolet irradiation portion 7*a* and the inkjet head 3 becomes wider than that when the irradiation portion 7*b* is turned on. Thus, stray light becomes less likely to reach the nozzles of the inkjet head 3. Therefore, it becomes possible to effectively suppress clogging of the nozzles of the inkjet head 3 due to stray light when the carriage 8 moves at the moving speed V2.

It can also be specified as a control method of the inkjet printer 1 according to the present embodiment.

Specifically, (5) The inkjet head 3 in which the plurality of nozzles that eject an ultraviolet-curable ink are formed, the ultraviolet irradiator 7 that irradiates ink ejected from the inkjet head 3 with ultraviolet to cure the ink, the carriage 8 on which the inkjet head 3 and the ultraviolet irradiator 7 are mounted, and the carriage drive mechanism 9 that moves the carriage 8 in the right-left direction (main scanning direction) are included.

The direction orthogonal to the right-left direction and the up-down direction is defined as the front-back direction (sub scanning direction).

A part of the ultraviolet irradiator 7 that is disposed at the same position as the inkjet head 3 in the front-back direction is defined as the head position ultraviolet irradiation portion 7*a*.

A predetermined moving speed V1 of the carriage 8 in the right-left direction is defined as the first moving speed, and the moving speed V2 slower than the moving speed V1 of the carriage 8 in the right-left direction is defined as the second moving speed.

The peak illuminance of ultraviolet with which the head position ultraviolet irradiation portion 7*a* irradiates ink when the carriage 8 moves at the moving speed V2 is made lower than the peak illuminance of ultraviolet with which the head position ultraviolet irradiation portion 7*a* irradiates ink when the carriage 8 moves at the moving speed V1.

When the carriage 8 moves at the moving speed V2 in order to print a high-resolution image, the time during which the print medium 2 is irradiated with ultraviolet becomes longer than that when the carriage 8 moves at the moving speed V1.

Therefore, with the above configuration, even if the time during which the print medium 2 is irradiated with ultraviolet becomes long, the amount of ultraviolet reflected on the print medium 2 is reduced by lowering the peak illuminance. This makes it possible to suppress the amount of ultraviolet that becomes stray light, and therefore it becomes possible to suppress clogging of the nozzles of the inkjet head 3 due to stray light. Therefore, it is possible to provide a control method of the printer 1 that can perform appropriate printing.

(First Modification of Lighting Control of Ultraviolet Irradiator 7)

In the embodiment described above, in a case where the current control is performed on the ultraviolet irradiator 7, by making the current supplied to a part of the head position ultraviolet irradiation portion 7*a* when the carriage 8 moves at the moving speed V2 lower than the current supplied to a part of the head position ultraviolet irradiation portion 7*a* when the carriage 8 moves at the moving speed V1, the controller 11 may make the peak illuminance of ultraviolet with which the head position ultraviolet irradiation portion 7*a* irradiates ink when the carriage 8 moves at the moving speed V2 lower than the peak illuminance of ultraviolet with which the head position ultraviolet irradiation portion 7*a* irradiates ink when the carriage 8 moves at the moving speed V1.

In this case, the controller 11 makes the current supplied to the irradiation portion 7*b* when the carriage 8 moves at the moving speed V2 lower than the current supplied to the irradiation portion 7*b* when the carriage 8 moves at the moving speed V1. Note that the current supplied to the irradiation portion 7*c* is constant. That is, the controller 11 reduces the current supplied to a part of the head position ultraviolet irradiation portion 7*a* on the inkjet head 3 side in the right-left direction when the carriage 8 moves at the moving speed V2.

This makes it possible to lower the illuminance of the irradiation portion 7*b* that is a part close to the inkjet head 3 when the carriage 8 moves at the moving speed V2.

Therefore, it is possible to lower the peak illuminance of ultraviolet with which the print medium 2 is irradiated when the carriage 8 moves at the moving speed V2.

Therefore, as compared with a case where the peak illuminance of ultraviolet irradiated is uniform regardless of the moving speeds V1 and V2 of the carriage 8, it is possible to suppress the amount of ultraviolet that becomes stray light and to suppress clogging of the nozzles of the inkjet head 3.

By making the current supplied to the entire head position ultraviolet irradiation portion 7*a* (both irradiation portions 7*b* and 7*c*) when the carriage 8 moves at the moving speed V2 lower than the current supplied to the entire head position ultraviolet irradiation portion 7*a* when the carriage 8 moves at the moving speed V1, the controller 11 may make the peak illuminance of ultraviolet with which the head position ultraviolet irradiation portion 7*a* irradiates ink when the carriage 8 moves at the moving speed V2 lower than the peak illuminance of ultraviolet with which the head position ultraviolet irradiation portion 7*a* irradiates ink when the carriage 8 moves at the moving speed V1.

The inkjet printer 1 according to the present embodiment has the following configuration.

(6) The controller 11 makes the current supplied to the irradiation portion 7*b*, which is a part of the head position ultraviolet irradiation portion 7*a*, when the carriage 8 moves at the moving speed V2 lower than the current supplied to the irradiation portion 7*b*, which is a part of the head position ultraviolet irradiation portion 7*a*, when the carriage 8 moves at the moving speed V1, or makes the current supplied to the entire head position ultraviolet irradiation portion 7*a* when the carriage 8 moves at the moving speed V2 lower than the current supplied to the entire head position ultraviolet irradiation portion 7*a* when the carriage 8 moves at the moving speed V1.

With this configuration, when the carriage 8 moves at the moving speed V2, even if the time during which the print medium 2 is irradiated with ultraviolet becomes long, the amount of ultraviolet that becomes stray light can be suppressed by lowering the peak illuminance. This makes it possible to suppress clogging of the nozzles of the inkjet head 3 due to stray light.

The inkjet printer 1 according to the present embodiment has the following configuration.

(7) The ultraviolet irradiator 7 and the inkjet heads 3 are adjacent to each other in the right-left direction.

The controller 11 reduces the current supplied to the irradiation portion 7*b*, which is a part of the head position ultraviolet irradiation portion 7*a* on the inkjet head 3 side in the right-left direction, when the carriage 8 moves at the moving speed V2.

With this configuration, the current supplied to the irradiation portion 7*b* becomes lower than the current supplied to the head position irradiation portion 7*a*. This makes it possible to lower the illuminance of the irradiation portion 7*b* on the side closer to the inkjet head 3 of the head position ultraviolet irradiation portion 7*a*.

This can reduce the cumulative light quantity of stray light reaching the nozzles of the inkjet head 3 as compared with that in the case of lowering the illuminance of the irradiation portion 7*c* on the side far from the inkjet head 3. Therefore, it becomes possible to suppress clogging of the nozzles of the inkjet head 3 due to stray light when the carriage 8 moves at the moving speed V2.

(Second Modification of Lighting Control of Ultraviolet Irradiator 7)

In the embodiment described above, in a case where the ultraviolet irradiator 7 is PWM (pulse width modulation)- controlled, by making the effective voltage applied to a part of the head position ultraviolet irradiation portion 7*a* (i.e., the ultraviolet irradiator 7) when the carriage 8 moves at the moving speed V2 lower than the effective voltage applied to a part of the head position ultraviolet irradiation portion 7*a* when the carriage 8 moves at the moving speed V1, the controller 11 may make the peak illuminance of ultraviolet with which the head position ultraviolet irradiation portion 7*a* irradiates ink when the carriage 8 moves at the moving speed V2 lower than the peak illuminance of ultraviolet with which the head position ultraviolet irradiation portion 7*a* irradiates ink when the carriage 8 moves at the moving speed V1.

In this case, the controller 11 makes the effective voltage applied to the irradiation portion 7*b* when the carriage 8 moves at the moving speed V2 lower than the effective voltage applied to the irradiation portion 7*b* when the carriage 8 moves at the moving speed V1. Note that the effective voltage supplied to the irradiation portion 7*c* is constant. That is, the controller 11 lowers the effective voltage applied to a part of the head position ultraviolet irradiation portion 7*a* on the inkjet head 3 side in the right-left direction when the carriage 8 moves at the moving speed V2.

This makes it possible to lower the illuminance of the irradiation portion 7*b* that is a part close to the inkjet head 3 when the carriage 8 moves at the moving speed V2.

Therefore, it is possible to lower the peak illuminance of ultraviolet with which the print medium 2 is irradiated when the carriage 8 moves at the moving speed V2. This suppresses the amount of ultraviolet that becomes stray light, and therefore it becomes possible to suppress clogging of the nozzles of the inkjet head 3.

By making the effective voltage applied to the entire head position ultraviolet irradiation portion 7*a* (both irradiation portions 7*b* and 7*c*) when the carriage 8 moves at the moving speed V2 lower than the effective voltage applied to the entire head position ultraviolet irradiation portion 7*a* when the carriage 8 moves at the moving speed V1, the controller 11 may make the peak illuminance of ultraviolet with which the head position ultraviolet irradiation portion 7*a* irradiates ink when the carriage 8 moves at the moving speed V2 lower than the peak illuminance of ultraviolet with which the head position ultraviolet irradiation portion 7*a* irradiates ink when the carriage 8 moves at the moving speed V1.

The inkjet printer 1 according to the present embodiment has the following configuration.

(8) The ultraviolet irradiator 7 is PWM-controlled.

The controller 11 makes the effective voltage applied to a part of the head position ultraviolet irradiation portion 7*a*, when the carriage 8 moves at the moving speed V2 lower than the effective voltage applied to a part of the head position ultraviolet irradiation portion 7*a*, when the carriage 8 moves at the moving speed V1, or makes the effective voltage applied to the entire head position ultraviolet irradiation portion 7*a* when the carriage 8 moves at the moving speed V2 lower than the effective voltage applied to the entire head position ultraviolet irradiation portion 7*a* when the carriage 8 moves at the moving speed V1.

When the carriage 8 moves at the moving speed V2, even if the time during which the print medium 2 is irradiated with ultraviolet becomes long, the amount of ultraviolet that becomes stray light can be suppressed by lowering the peak illuminance. This makes it possible to suppress clogging of the nozzles of the inkjet head 3 due to stray light.

The inkjet printer 1 according to the present embodiment has the following configuration.

(9) The ultraviolet irradiator 7 and the inkjet heads 3 are adjacent to each other in the right-left direction.

The controller 11 reduces the effective voltage applied to the irradiation portion 7*b*, which is a part of the head position ultraviolet irradiation portion 7*a* on the inkjet head 3 side in the right-left direction, when the carriage 8 moves at the moving speed V2.

This configuration makes it possible to lower the illuminance of the irradiation portion 7*b* on the side closer to the inkjet head 3 of the head position ultraviolet irradiation portion 7*a*.

This can reduce the cumulative light quantity of stray light reaching the nozzles of the inkjet head 3 as compared with that in the case of lowering the illuminance of the irradiation portion 7*c* on the side far from the inkjet head 3. Therefore, it becomes possible to effectively suppress clogging of the nozzles of the inkjet head 3 due to stray light when the carriage 8 moves at the moving speed V2.

(First Modification)

Figure 3:
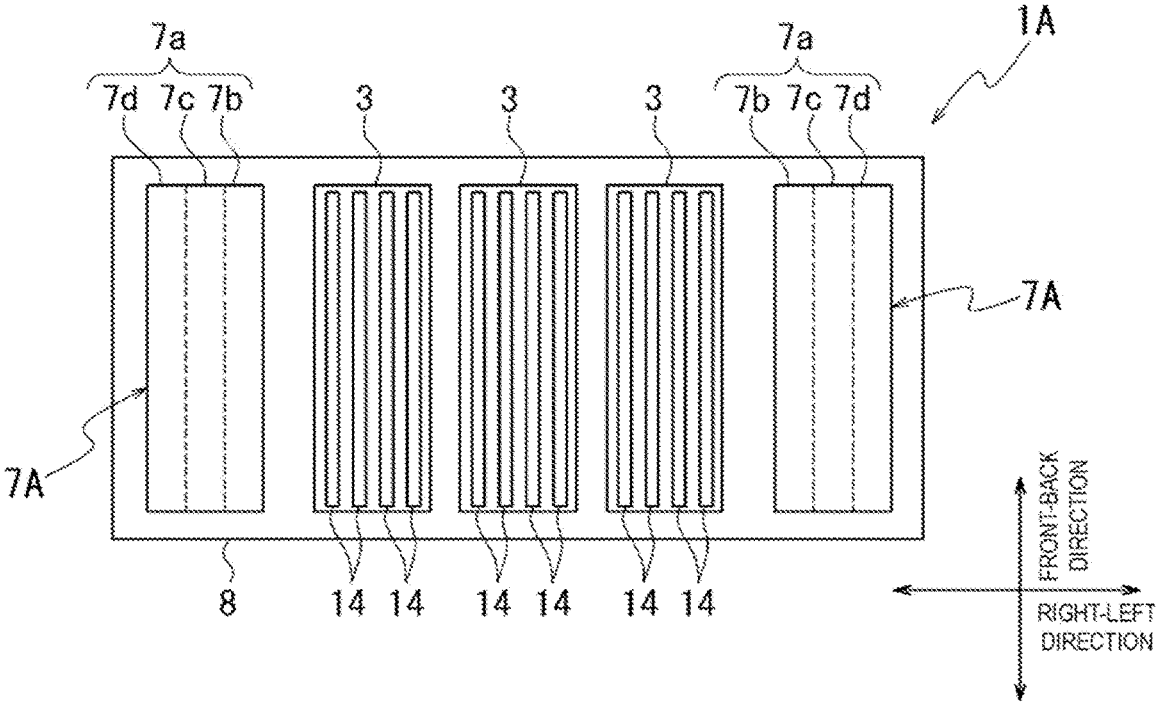
FIG. 3 is a view for explaining an inkjet printer according to a first modification.

FIG. 3 is a view for explaining an inkjet printer 1A according to the first modification.

In the following explanation, description of parts common to the inkjet printer 1 according to the present embodiment will be omitted.

As shown in FIG. 3, the inkjet printer 1A includes an ultraviolet irradiator 7A. A head position ultraviolet irradiation portion 7*a* of the ultraviolet irradiator 7A is partitioned into irradiation portions 7*b*, 7*c*, and 7*d* adjacent in the right-left direction. The irradiation portions 7*b*, 7*c*, and 7*d* are arranged in this order in an orientation away from an inkjet head 3 in the right-left direction. The irradiation portions 7*b*, 7*c*, and 7*d* can be individually controlled to be turned on.

In this case, a predetermined moving speed of the carriage 8 in the right-left direction is set as a moving speed V5, a moving speed slower than the moving speed V5 of the carriage 8 in the right-left direction is set as a moving speed V6, and a moving speed slower than the moving speed V6 of the carriage 8 in the right-left direction is set as a moving speed V7.

In the inkjet printer 1A, the controller 11 sets the peak illuminance of ultraviolet irradiated from the head position ultraviolet irradiation portion 7*a* when moving the carriage 8 at the moving speed V6 to be lower than the peak illuminance of ultraviolet irradiated from the head position ultraviolet irradiation portion 7*a* when moving the carriage 8 at the moving speed V5. The controller 11 makes the peak illuminance of ultraviolet with which the head position ultraviolet irradiation portion 7*a* irradiates ink when the carriage 8 moves at the moving speed V7 lower than the peak illuminance of ultraviolet with which the head position ultraviolet irradiation portion 7*a* irradiates ink when the carriage 8 moves at the moving speed V6. The moving speed V5 in this case is the first moving speed, and the moving speeds V6 and V7 are the second moving speeds.

Specifically, the controller 11 turns on the entire head position ultraviolet irradiation portion 7*a* (irradiation portions 7*b*, 7*c*, and 7*d*) when the carriage 8 moves at the moving speed V5. When the carriage 8 moves at the moving speed V6, the controller 11 turns on the irradiation portions 7*c* and 7*d* and turns off the irradiation portion 7*b*. When the carriage 8 moves at the moving speed V7, the controller 11 turns on the irradiation portion 7*d* and turns off the irradiation portions 7*b* and 7*c*.

That is, when the carriage 8 moves at the moving speeds V6 and V7, the controller 11 turns off a part of the head position ultraviolet irradiation portion 7*a* on the inkjet head 3 side in the right-left direction.

The controller 11 changes, according to the moving speed of the carriage 8, the peak illuminance of ultraviolet with which the head position ultraviolet irradiation portion 7*a* irradiates ink so that the value obtained by dividing the peak illuminance of ultraviolet with which the head position ultraviolet irradiation portion 7*a* irradiates ink when the carriage 8 moves at the moving speed V5 by the moving speed V5, the value obtained by dividing the peak illuminance of ultraviolet with which the head position ultraviolet irradiation portion 7*a* irradiates ink when the carriage 8 moves at the moving speed V6 by the moving speed V6, and the value obtained by dividing the peak illuminance of ultraviolet with which the head position ultraviolet irradiation portion 7*a* irradiates ink when the carriage 8 moves at the moving speed V7 by the moving speed V7 become equal.

For example, the moving speed V6 is a speed of two-thirds of the moving speed V5, and the peak illuminance of ultraviolet with which the head position ultraviolet irradiation portion 7*a* irradiates ink when the carriage 8 moves at the moving speed V6 is an illuminance of two-thirds of the peak illuminance of ultraviolet with which the head position ultraviolet irradiation portion 7*a* irradiates ink when the carriage 8 moves at the moving speed V5. The moving speed V7 is a speed of one-third of the moving speed V5, and the peak illuminance of ultraviolet with which the head position ultraviolet irradiation portion 7*a* irradiates ink when the carriage 8 moves at the moving speed V7 is an illuminance of one-third of the peak illuminance of ultraviolet with which the head position ultraviolet irradiation portion 7*a* irradiates ink when the carriage 8 moves at the moving speed V5.

Also doing this enables the cumulative light quantity (cumulative illuminance), which is the product of the peak illuminance of ultraviolet with which the head position ultraviolet irradiation portion 7*a* irradiates ink and the irradiation time of ultraviolet, to be made constant regardless of the moving speed of the carriage 8.

(Second Modification)

Figure 4:
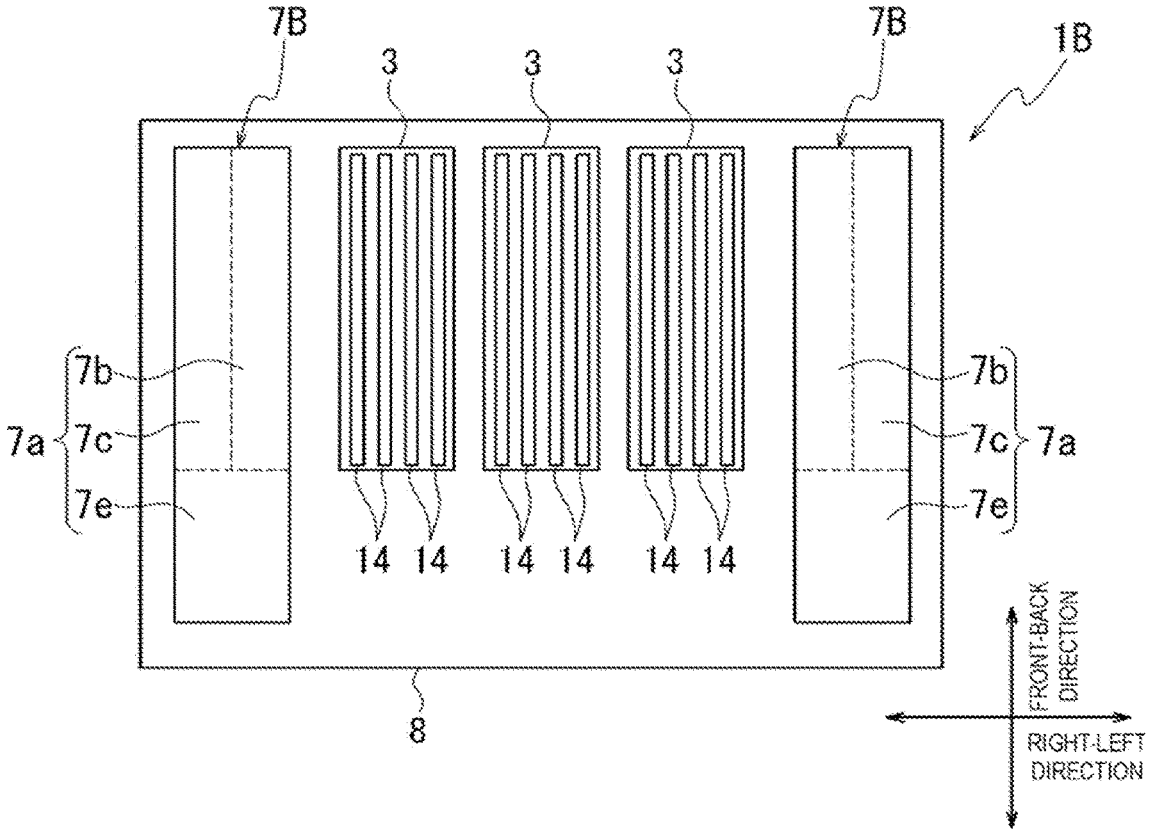
FIG. 4 is a view for explaining an inkjet printer according to a second modification.

FIG. 4 is a view for explaining an inkjet printer 1B according to the second modification.

In the following explanation, description of parts common to the inkjet printer 1 according to the present embodiment will be omitted.

For example, when multi-pass printing is performed on the print medium 2, it is necessary to reliably cure the ink ejected from the inkjet head 3 in the final pass. The inkjet printer 1B according to the second modification has an ultraviolet irradiator 7B having a length longer than the entire length of the inkjet head 3 in the front-back direction.

As shown in FIG. 4, the ultraviolet irradiator 7B of the inkjet printer 1B includes a head position ultraviolet irradiation portion (pinning region) 7*a* disposed at the same position as the inkjet head 3 in the front-back direction, and an irradiation portion (curing region) 7*e* disposed at a position shifted from the inkjet head 3 in the front-back direction.

The head position ultraviolet irradiation portion 7*a* of the ultraviolet irradiator 7B is partitioned into irradiation portions 7*b* and 7*c* adjacent in the right-left direction. The irradiation portion 7*b* is disposed on the inkjet head 3 side in the right-left direction.

The controller 11 makes the peak illuminance of ultraviolet with which the head position ultraviolet irradiation portion 7*a* irradiates ink when the carriage 8 moves at the moving speed V2 lower than the peak illuminance of ultraviolet with which the head position ultraviolet irradiation portion 7*a* irradiates ink when the carriage 8 moves at the moving speed V1. Specifically, the controller 11 turns on the entire head position ultraviolet irradiation portion 7*a* when the carriage 8 moves at the moving speed V1, and turns on the irradiation portion 7*c* and turns off the irradiation portion 7*b* when the carriage 8 moves at the moving speed V2.

On the other hand, the controller 11 turns on the entire irradiation portion 7*e* regardless of the moving speed of the carriage 8. That is, the peak illuminance of ultraviolet with which the irradiation portion 7*e* irradiates ink when the carriage 8 moves at the moving speed V1 is equal to the peak illuminance of ultraviolet with which the irradiation portion 7*e* irradiates ink when the carriage 8 moves at the moving speed V2.

The controller 11 may make the peak illuminance of ultraviolet with which the irradiation portion 7*e* irradiates ink when the carriage 8 moves at the moving speed V2 lower than the peak illuminance of ultraviolet with which the irradiation portion 7*e* irradiates ink when the carriage 8 moves at the moving speed V1. Although not illustrated, the irradiation portion 7*e* is only required to be divided into, for example, a plurality of irradiation portions adjacent in the right-left direction.

Here, the value obtained by dividing the peak illuminance of ultraviolet with which the head position ultraviolet irradiation portion 7*a* irradiates ink when the carriage 8 moves at the moving speed V1 by the moving speed V1 and the value obtained by dividing the peak illuminance of ultraviolet with which the head position ultraviolet irradiation portion 7*a* irradiates ink when the carriage 8 moves at the moving speed V2 by the moving speed V2 may be different.

That is, the controller 11 may change, according to the moving speed of the carriage 8, the peak illuminance of ultraviolet with which the head position ultraviolet irradiation portion 7*a* irradiates ink so that the value obtained by dividing the peak illuminance of ultraviolet with which the head position ultraviolet irradiation portion 7*a* irradiates ink by the moving speed of the carriage 8 slightly fluctuates according to the moving speed of the carriage 8.

Also doing this enables the cumulative light quantity of the ultraviolet with which ink is irradiated to be made constant.

Figure 5:
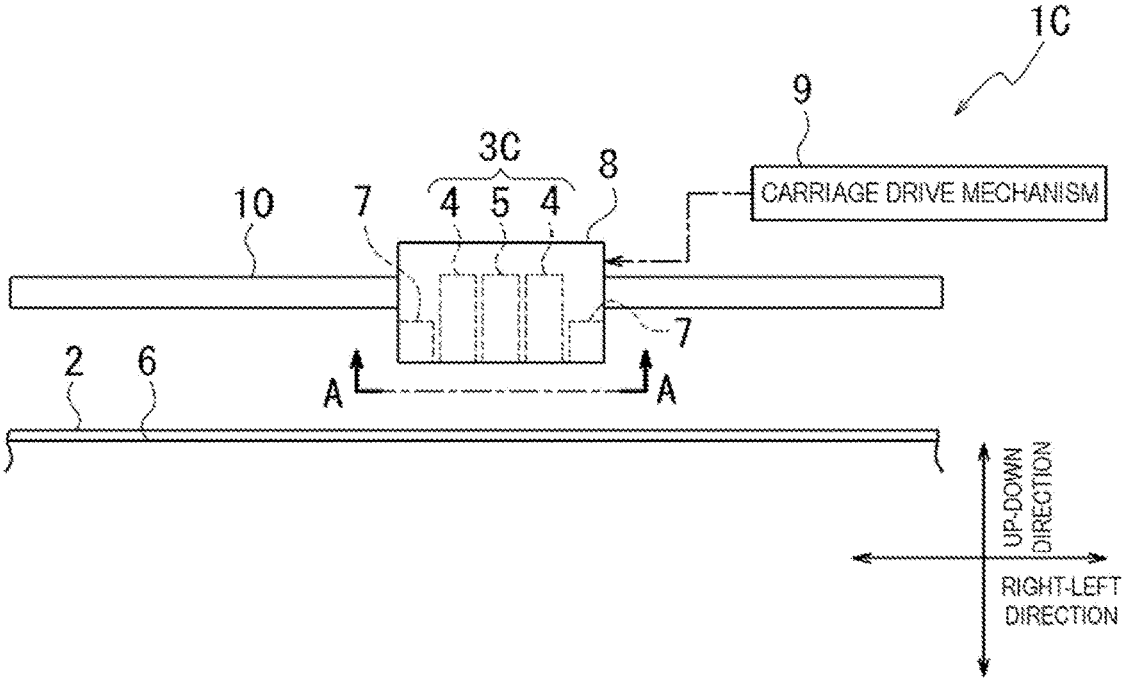
FIG. 5 is a view for explaining an inkjet printer according to a third modification.

FIG. 5 is a view for explaining an inkjet printer 1C according to the third modification.

Figure 6:
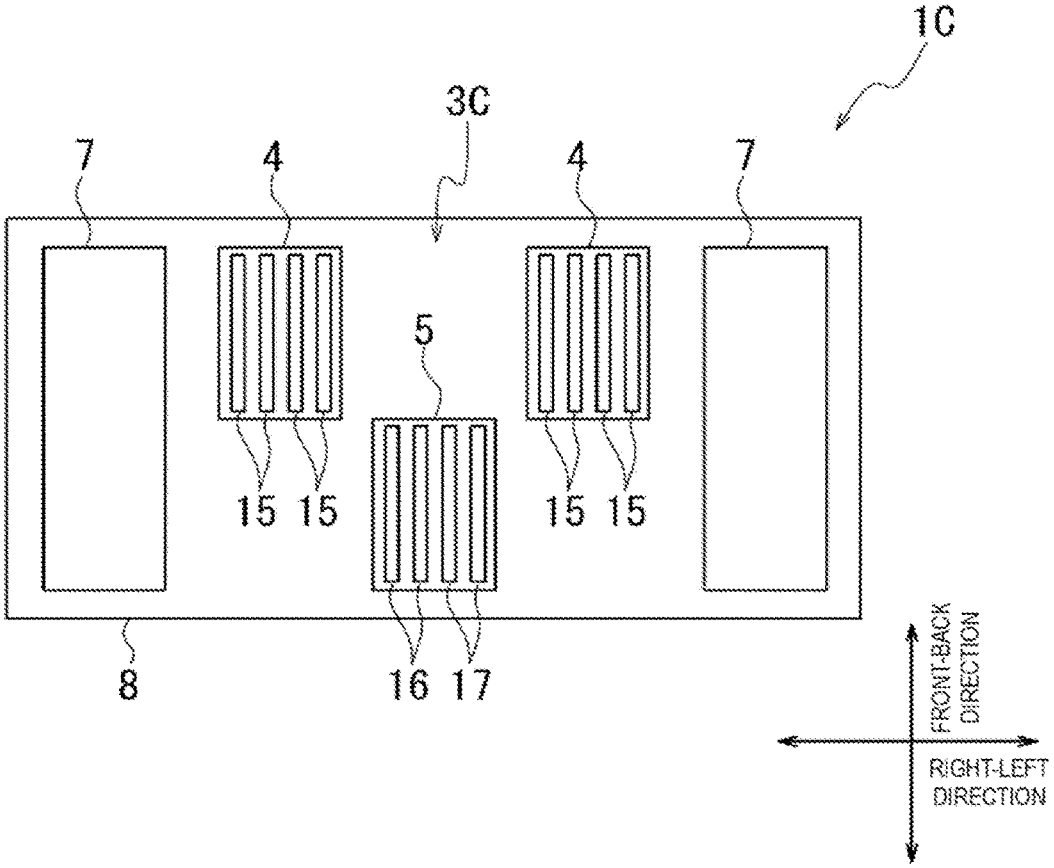
FIG. 6 is a view for explaining the inkjet printer according to the third modification.

FIG. 6 is a view of a carriage 8 in FIG. 5 as viewed from the direction of the arrow A-A.

Note that parts common to the inkjet printer 1 (see FIG. 1) according to the present embodiment will be described using the same reference signs.

The ultraviolet-curable ink used for printing includes a color ink for coloring, a white ink for base, and a transparent clear ink for overcoating.

The inventor of the present application has found that the cumulative light quantity (cumulative illuminance) of ultraviolet necessary when the clear ink cures is smaller than the cumulative light quantity of ultraviolet necessary when the color ink or the white ink cures. Therefore, the inventor has found that clogging of a nozzle that ejects the clear ink is most likely to occur.

As shown in FIG. 5, an inkjet head 3C of the inkjet printer 1C (hereinafter, also referred to as a "printer 1C".) according to the third modification includes two inkjet heads 4 (hereinafter, also referred to as "heads 4".) and one inkjet head 5 (hereinafter, also referred to as "head 5".). The heads 4 are first inkjet heads, and the head 5 is a second inkjet head.

As shown in FIG. 6, an ultraviolet irradiator 7 is mounted on the carriage 8 on each of one end side and the other end side in the right-left direction. On the carriage 8, the inkjet head 3C is disposed between the ultraviolet irradiators 7 and 7 in the right-left direction. The inkjet head 3C and the ultraviolet irradiator 7 are adjacent to each other in the right-left direction.

The heads 4 and 4 in the inkjet head 3C are disposed at the same position in the front-back direction. The head 5 in the inkjet head 3C is disposed between the heads 4 and 4 in the right-left direction, and is disposed at a position shifted from the heads 4 and 4 in the front-back direction. The ultraviolet irradiator 7 has a length that crosses the heads 4 and 5 in the front-back direction.

The heads 4 and 5 eject ink toward the print medium 2 placed on the table 6 (see FIG. 5). On a surface of the head 4 that faces the print medium 2, a color ink nozzle row 15 in which a plurality of nozzles that eject a color ink for coloring are arranged in the front-back direction is formed. On a surface of the head 5 that faces the print medium 2, a white ink nozzle row 16 in which a plurality of nozzles that eject a white ink for base are arranged in the front-back direction, and a clear ink nozzle row 17 in which a plurality of nozzles that eject a transparent clear ink for overcoating are arranged in the front-back direction are formed.

As shown in FIG. 6, in each of the two heads 4, four color ink nozzle rows 15 are arranged at intervals in the right-left direction.

Each of the four color ink nozzle rows 15 includes a color ink nozzle row that ejects a color ink of black (K color), a color ink nozzle row that ejects a color ink of yellow (Y color), a color ink nozzle row that ejects a color ink of cyan (C color), and a color ink nozzle row that ejects a color ink of magenta (M color).

As shown in FIG. 6, in the one head 5, two white ink nozzle rows 16 and two clear ink nozzle rows 17 are arranged at intervals in the right-left direction.

Specifically, the two white ink nozzle rows 16 are arranged on the left side of the head 5, and the two clear ink nozzle rows 17 are arranged on the right side of the head 5. Note that the two white ink nozzle rows 16 may be disposed on the right side of the head 5, and the two clear ink nozzle rows 17 may be disposed on the left side of the head 5.

As shown in FIG. 6, the heads 4 having the color ink nozzle rows 15 are arranged at positions shifted from the head 5 having the white ink nozzle rows 16 and the clear ink nozzle rows 17 in the front-back direction. The heads 4 and the head 5 are arranged in a so-called staggered arrangement.

In this state, the color ink nozzle rows 15 and 15 are arranged on each of the both sides in the right-left direction of the white ink nozzle rows 16 and the clear ink nozzle rows 17. The four color ink nozzle rows 15 are arranged between the clear ink nozzle rows 17 and the ultraviolet irradiator 7 on the right side in the right-left direction. The four color ink nozzle rows 15 and the two white ink nozzle rows 16 are arranged between the clear ink nozzle rows 17 and the ultraviolet irradiator 7 on the left side in the right-left direction.

(Effects)

As described above, in the inkjet printer 1C according to the third modification, in the right-left direction, the color ink nozzle rows 15 are arranged between the clear ink nozzle rows 17 and the ultraviolet irradiator 7 on the right side, and the color ink nozzle rows 15 and the white ink nozzle rows 16 are arranged between the clear ink nozzle rows 17 and the ultraviolet irradiator 7 on the left side.

That is, at least the color ink nozzle rows 15 are arranged between the clear ink nozzle rows 17 and the ultraviolet irradiator 7 in the right-left direction.

This widens the interval between the clear ink nozzle rows 17 and the ultraviolet irradiator 7 in the right-left direction. Therefore, even if ultraviolet is irradiated from the ultraviolet irradiator 7, stray light is less likely to reach the clear ink nozzle rows 17, and it becomes therefore possible to suppress the nozzles of the clear ink nozzle rows 17 from clogging due to the influence of stray light.

In the inkjet printer 1C according to the third modification, the white ink nozzle rows 16 and the clear ink nozzle rows 17 are formed in the head 5 that is common. Therefore, the configuration of the inkjet head 3C can be simplified as compared with that in a case where the head in which the white ink nozzle row 16 is formed and the head in which the clear ink nozzle row 17 is formed are separately provided.

Nozzles are not formed at both ends of the heads 4 and 5 in the front-back direction. Therefore, if the heads 4 and 5 are disposed at the same position in the front-back direction, continuity of the nozzle rows between the heads 4 and 5 in the front-back direction is impaired, and thus there is a concern that streak-like unevenness is generated in the printed matter and the print quality deteriorates. In particular, when multi-pass printing is performed, streak-like unevenness is likely to be generated.

On the other hand, in the inkjet printer 1C according to the third modification, the heads 4 (color ink nozzle rows 15) are disposed in a so-called staggered arrangement disposed at positions shifted from the head 5 (white ink nozzle rows 16 and clear ink nozzle rows 17) in the front-back direction.

This makes the nozzle rows between the heads 4 and 5 continuous in the front-back direction. Therefore, even if multi-pass printing is performed, the undercoat or the overcoat can be continuously applied to the color ink, so that deterioration of the printing quality due to generation of streak-like unevenness can be prevented.

The inkjet printer 1C according to the third modification has the following configuration.

(10) The inkjet printer 1C includes:

the inkjet head 3C in which the plurality of nozzle rows that eject an ultraviolet-curable ink are formed; the ultraviolet irradiator 7 that irradiates ink ejected from the inkjet head 3C with ultraviolet to cure the ink; the carriage 8 on which the inkjet head 3C and the ultraviolet irradiator 7 are mounted; and the carriage drive mechanism 9 that moves the carriage 8 in the right-left direction (main scanning direction).

The ultraviolet irradiator 7 and the inkjet head 3C are adjacent to each other in the right-left direction.

In the inkjet head 3C, the color ink nozzle rows 15, which are nozzle rows that eject an ultraviolet-curable color ink, the white ink nozzle rows 16, which are nozzle rows that eject an ultraviolet-curable white ink, and the clear ink nozzle rows 17, which are nozzle rows that eject an ultraviolet-curable transparent clear ink, are formed.

The color ink nozzle rows 15, the white ink nozzle rows 16, and the clear ink nozzle rows 17 include a plurality of nozzles arranged in the front-back direction (sub scanning direction) orthogonal to the right-left direction and the up-down direction.

The white ink nozzle rows 16 and the clear ink nozzle rows 17 are arranged at the same positions in the front-back direction.

The color ink nozzle rows 15 are arranged at positions shifted from the white ink nozzle rows 16 and the clear ink nozzle rows 17 in the front-back direction.

At least the color ink nozzle rows 15 are arranged between the clear ink nozzle rows 17 and the ultraviolet irradiator 7 in the right-left direction.

With this configuration, the interval in the right-left direction between the ultraviolet irradiator 7 and the clear ink nozzle rows 17 can be widened by the provision of the color ink nozzle rows 15. Therefore, even if ultraviolet is irradiated from the ultraviolet irradiator 7, stray light is less likely to reach the clear ink nozzle rows 17, and it becomes therefore possible to suppress the nozzles of the clear ink nozzle rows 17 from clogging due to the influence of stray light.

With the above configuration, the color ink nozzle rows 15 become continuous in the front-back direction with respect to the white ink nozzle rows 16 and the clear ink nozzle rows 17. Therefore, even if multi-pass printing is performed, the undercoat or the overcoat can be continuously applied to the color ink, so that deterioration of the printing quality due to generation of streak-like unevenness can be prevented.

The inkjet printer 1C according to the third modification has the following configuration.

(11) The ultraviolet irradiators 7 are provided on both sides of the inkjet head 3C in the right-left direction.

The white ink nozzle rows 16 and the clear ink nozzle rows 17 are arranged adjacent to each other in the right-left direction.

The color ink nozzle rows 15 are arranged on each of the both sides in the right-left direction of the white ink nozzle rows 16 and the clear ink nozzle rows 17.

With this configuration, the interval in the right-left direction between the ultraviolet irradiator 7 and the clear ink nozzle rows 17 can be widened even if the ultraviolet irradiators 7 are arranged on both sides of the inkjet head 3C in the right-left direction. Therefore, even if ultraviolet is irradiated from either of the right and left ultraviolet irradiators 7, stray light is less likely to reach the clear ink nozzle rows 17, and it becomes therefore possible to suppress the nozzles of the clear ink nozzle rows 17 from clogging due to the influence of stray light.

The inkjet printer 1C according to the third modification has the following configuration.

(13) The inkjet head 3C includes a head 4 (first inkjet head) in which the plurality of color ink nozzle rows 15 are formed, and a head 5 (second inkjet head) in which the white ink nozzle rows 16 and the clear ink nozzle rows 17 are formed.

With this configuration, the configuration of the inkjet head 3C can be simplified as compared with that in a case where the inkjet head in which the white ink nozzle row 16 is formed and the inkjet head in which the clear ink nozzle row 17 is formed are separately provided.

Figure 7:
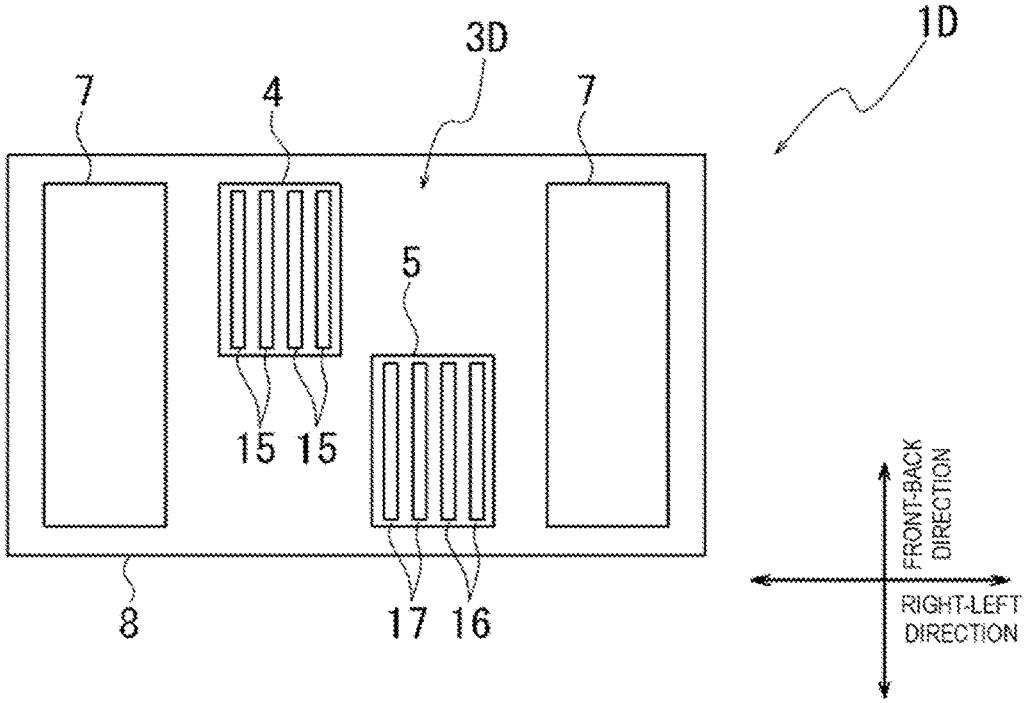
FIG. 7 is a view for explaining an inkjet printer according to a fourth modification.

FIG. 7 is a view for explaining an inkjet printer 1D according to the fourth modification.

Figure 8:
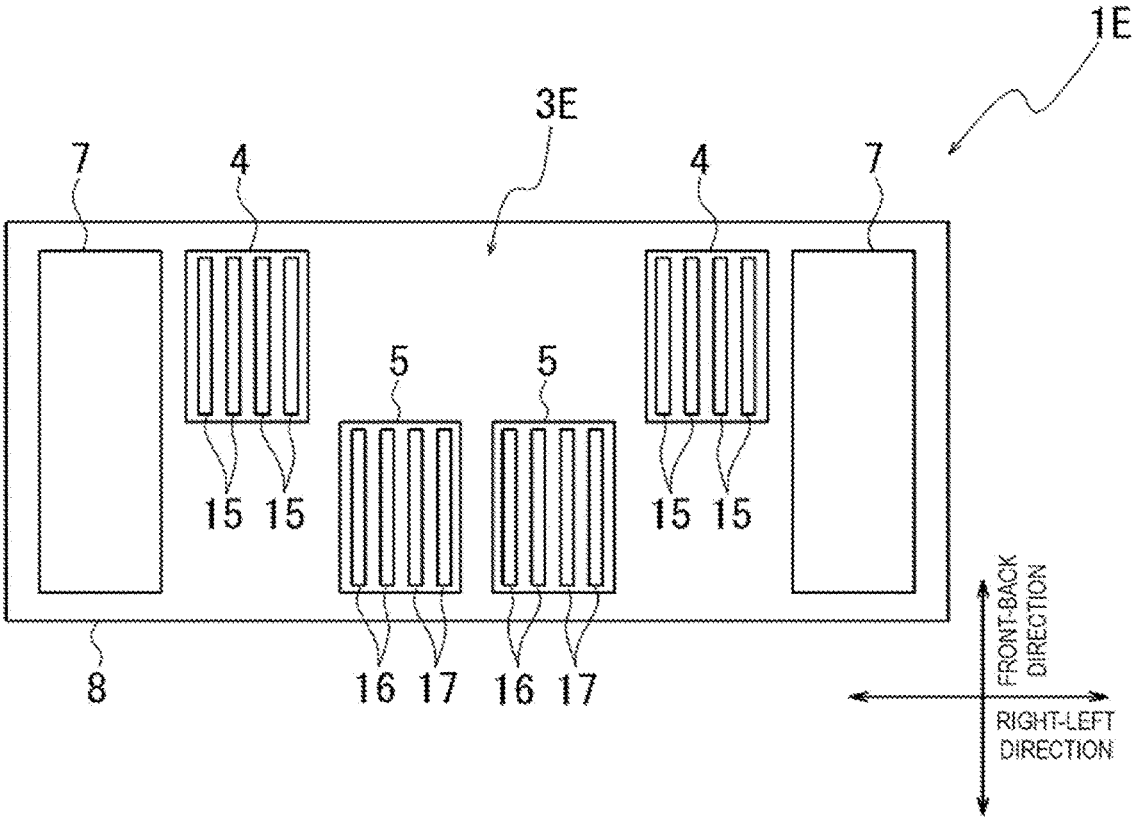
FIG. 8 is a view for explaining an inkjet printer according to a fifth modification.

FIG. 8 is a view for explaining an inkjet printer 1E according to the fifth modification.

Figure 9:
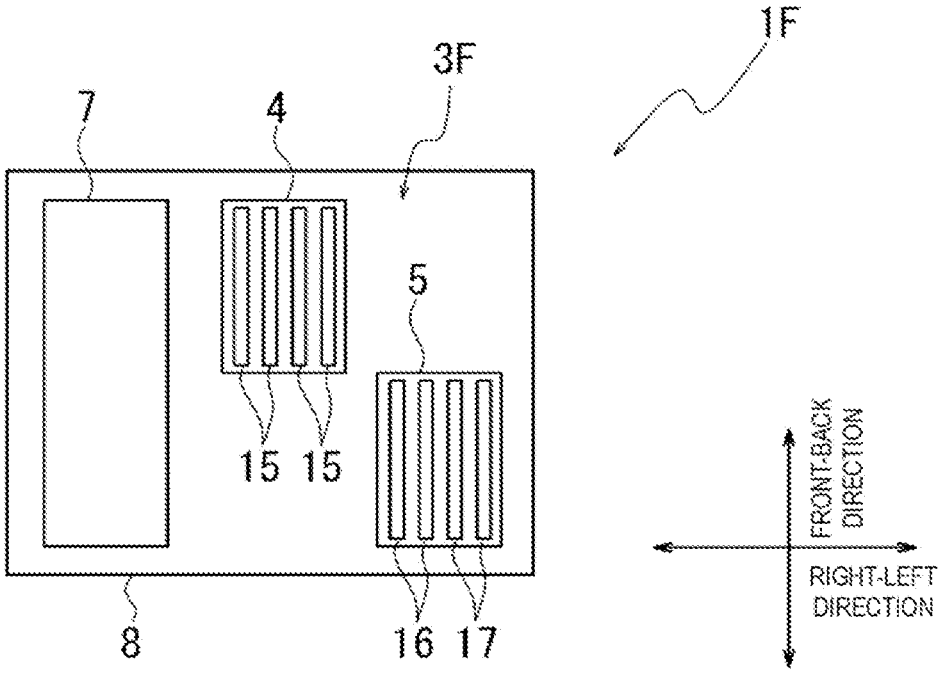
FIG. 9 is a view for explaining an inkjet printer according to a sixth modification.

FIG. 9 is a view for explaining an inkjet printer 1F according to the sixth modification.

Figure 10:
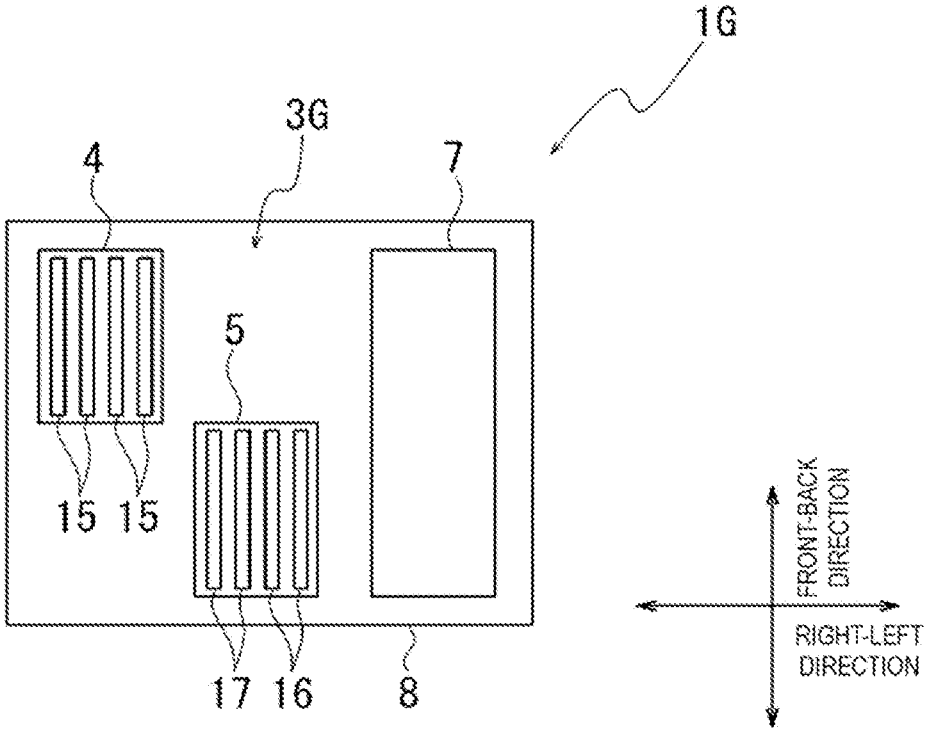
FIG. 10 is a view for explaining an inkjet printer according to a seventh modification.

FIG. 10 is a view for explaining an inkjet printer 1G according to the seventh modification.

In the following explanation, description of parts common to the inkjet printer 1C according to the third modification will be omitted.

As shown in FIG. 7, an inkjet head 3D of the inkjet printer 1D is provided with one head 4 and one head 5. In the head 5, the clear ink nozzle rows 17 are arranged on the side where the head 4 is arranged in the right-left direction.

That is, on the right side of the clear ink nozzle rows 17, two white ink nozzle rows 16 are arranged between the clear ink nozzle rows 17 and the ultraviolet irradiator 7. On the left side of the clear ink nozzle rows 17, four color ink nozzle rows 15 are arranged between the clear ink nozzle rows 17 and the ultraviolet irradiator 7.

By doing this, it becomes possible to widen the interval between the clear ink nozzle rows 17 and the ultraviolet irradiator 7 in the right-left direction, and it becomes therefore possible to suppress the nozzles of the clear ink nozzle rows 17 from clogging due to the influence of stray light.

As shown in FIG. 8, an inkjet head 3E of the inkjet printer 1E is provided with two heads 4 and two heads 5. The two heads 5 and 5 are disposed at the same position in the front-back direction. The two heads 5 and 5 are disposed between the two heads 4 and 4 in the right-left direction.

By doing this, it becomes possible to widen the interval between the clear ink nozzle rows 17 and the ultraviolet irradiator 7 in the right-left direction, and it becomes therefore possible to suppress the nozzles of the clear ink nozzle rows 17 from clogging due to the influence of stray light.

Although not illustrated, the number of each of the heads 4 and 5 may be three or more. Even in this case, at least the color ink nozzle rows 15 are arranged between the clear ink nozzle rows 17 and the ultraviolet irradiator 7 in the right-left direction.

The inkjet printer 1E according to the fifth modification has the following configuration.

(14) The inkjet head 3E in which the plurality of nozzle rows that eject an ultraviolet-curable ink are formed, the ultraviolet irradiator 7 that irradiates ink ejected from the inkjet head 3E with ultraviolet to cure the ink, the carriage 8 on which the inkjet head 3E and the ultraviolet irradiator 7 are mounted, and the carriage drive mechanism 9 that moves the carriage 8 in the right-left direction (main scanning direction) are included.

The ultraviolet irradiators 7 are provided on both sides of the inkjet head 3E in the right-left direction.

In the inkjet head 3E, the color ink nozzle rows 15, which are nozzle rows that eject an ultraviolet-curable color ink, the white ink nozzle rows 16, which are nozzle rows that eject an ultraviolet-curable white ink, and the clear ink nozzle rows 17, which are nozzle rows that eject an ultraviolet-curable transparent clear ink, are formed.

The color ink nozzle rows 15, the white ink nozzle rows 16, and the clear ink nozzle rows 17 include a plurality of nozzles arranged in the front-back direction (sub scanning direction) orthogonal to the right-left direction and the up-down direction.

At least the color ink nozzle rows 15 are arranged between the clear ink nozzle rows 17 and the ultraviolet irradiator 7 in the right-left direction.

With this configuration, the interval in the right-left direction between the ultraviolet irradiator 7 and the clear ink nozzle rows 17 can be widened by the arrangement of the color ink nozzle rows 15. Therefore, even if ultraviolet is irradiated from either of the right and left ultraviolet irradiators 7, stray light is less likely to reach the clear ink nozzle rows 17, and it becomes therefore possible to suppress the nozzles of the clear ink nozzle rows 17 from clogging due to the influence of stray light.

The inkjet printer 1E according to the fifth modification has the following configuration.

(15) The white ink nozzle rows 16 and the clear ink nozzle rows 17 are arranged adjacent to each other in the right-left direction.

The color ink nozzle rows 15 are arranged on each of the both sides in the right-left direction of the white ink nozzle rows 16 and the clear ink nozzle rows 17.

The white ink nozzle rows 16 and the clear ink nozzle rows 17 are arranged at the same positions in the front-back direction.

The color ink nozzle rows 15 are arranged at positions shifted from the white ink nozzle rows 16 and the clear ink nozzle rows 17 in the front-back direction.

With this configuration, the color ink nozzle rows 15 become continuous in the front-back direction with respect to the white ink nozzle rows 16 and the clear ink nozzle rows 17. Therefore, even if multi-pass printing is performed, the undercoat or the overcoat can be continuously applied to the color ink, so that deterioration of the printing quality due to generation of streak-like unevenness can be prevented.

As shown in FIG. 9, the ultraviolet irradiator 7 mounted on the carriage 8 may be one inkjet printer 1F.

In the inkjet printer 1F, the number of the ultraviolet irradiator 7 mounted on the carriage 8 is one, and the number of each of the heads 4 and 5 of the inkjet head 3F is one. The head 4 is disposed between the head 5 and the ultraviolet irradiator 7 in the right-left direction.

In the head 5, the white ink nozzle rows 16 are arranged on the side where the head 4 is disposed in the right-left direction, and the clear ink nozzle rows 17 are arranged on the side opposite to the side where the head 4 is disposed. The clear ink nozzle rows 17 may be disposed on the side where the head 4 is disposed in the right-left direction, and the white ink nozzle rows 16 may be disposed on the side opposite to the side where the head 4 is disposed. That is, at least the color ink nozzle rows 15 are only required to be disposed between the clear ink nozzle rows 17 and the ultraviolet irradiator 7.

The inkjet printer 1F according to the sixth modification has the following configuration.

(17) The inkjet printer 1F includes:

the inkjet head 3F in which the plurality of nozzle rows that eject an ultraviolet-curable ink are formed; the ultraviolet irradiator 7 that irradiates ink ejected from the inkjet head 3F with ultraviolet to cure the ink; the carriage 8 on which the inkjet head 3F and the ultraviolet irradiator 7 are mounted; and the carriage drive mechanism 9 that moves the carriage 8 in the right-left direction (main scanning direction).

The inkjet head 3F and the ultraviolet irradiator 7 are adjacent to each other in the right-left direction.

In the inkjet head 3F, color ink nozzle rows 15, which are nozzle rows that eject an ultraviolet-curable color ink, white ink nozzle rows 16, which are nozzle rows that eject an ultraviolet-curable white ink, and clear ink nozzle rows 17, which are nozzle rows that eject an ultraviolet-curable transparent clear ink, are formed.

The color ink nozzle rows 15, the white ink nozzle rows 16, and the clear ink nozzle rows 17 include a plurality of nozzles arranged in the front-back direction (sub scanning direction) orthogonal to the right-left direction and the up-down direction.

The white ink nozzle rows 16 and the clear ink nozzle rows 17 are arranged at the same positions in the front-back direction.

The color ink nozzle rows 15 are arranged at positions shifted from the white ink nozzle rows 16 and the clear ink nozzle rows 17 in the front-back direction.

The color ink nozzle rows 15 and the white ink nozzle rows 16 are arranged between the clear ink nozzle rows 17 and the ultraviolet irradiator 7 in the right-left direction.

With this configuration, the interval between the clear ink nozzle rows 17 and the ultraviolet irradiator 7 in the right-left direction is widened by the provision of the color ink nozzle rows 15 and the white ink nozzle rows 16.

Therefore, even if ultraviolet is irradiated from the ultraviolet irradiator 7, stray light is less likely to reach the clear ink nozzle rows 17, and it becomes therefore possible to suppress the nozzles of the clear ink nozzle rows 17 from clogging due to the influence of stray light.

With the above configuration, the color ink nozzle rows 15 become continuous in the front-back direction with respect to the white ink nozzle rows 16 and the clear ink nozzle rows 17. Therefore, even if multi-pass printing is performed, the undercoat or the overcoat can be continuously applied to the color ink, so that deterioration of the printing quality due to generation of streak-like unevenness can be prevented.

As shown in FIG. 10, the inkjet printer 1G in which the head 5 is disposed between the head 4 and the ultraviolet irradiator 7 in the right-left direction may be provided.

In the head 5, the white ink nozzle rows 16 are arranged on the side where the ultraviolet irradiator 7 is disposed in the right-left direction, and the clear ink nozzle rows 17 are arranged on the side opposite to the side where the ultraviolet irradiator 7 is disposed. That is, in the inkjet printer 1G, the white ink nozzle rows 16 are arranged between the clear ink nozzle rows 17 and the ultraviolet irradiator 7 in the right-left direction.

Thus, the interval between the clear ink nozzle rows 17 and the ultraviolet irradiator 7 in the right-left direction is widened by the provision of the white ink nozzle rows 16.

Therefore, even if ultraviolet is irradiated from the ultraviolet irradiator 7, stray light is less likely to reach the clear ink nozzle rows 17, and it becomes therefore possible to suppress the nozzles of the clear ink nozzle rows 17 from clogging due to the influence of stray light.

Regarding the modifications shown in FIG. 5 to FIG. 10, the inkjet heads 3C to 3G may separately include the head in which the white ink nozzle rows 16 are formed and the head in which the clear ink nozzle rows 17 are formed. In this case, the head in which the white ink nozzle rows 16 are formed and the head in which the clear ink nozzle rows 17 are formed may be disposed at positions shifted in the front-back direction. In this case, the white ink nozzle rows 16 may be formed on the left side of the head 4 disposed on the left side or the right side of the head 4 disposed on the right side.

Regarding the modifications shown in FIG. 5 to FIG. 10, the head 4 and the head 5 may be disposed at the same position in the front-back direction. The color ink nozzle rows 15, the white ink nozzle rows 16, and the clear ink nozzle rows 17 may be formed in one head. Furthermore, the number of color ink nozzle rows 15 formed in the head 4 may be three or less, or may be five or more. One white ink nozzle row 16 and one clear ink nozzle row 17 may be formed in the head 5.

Figure 11:
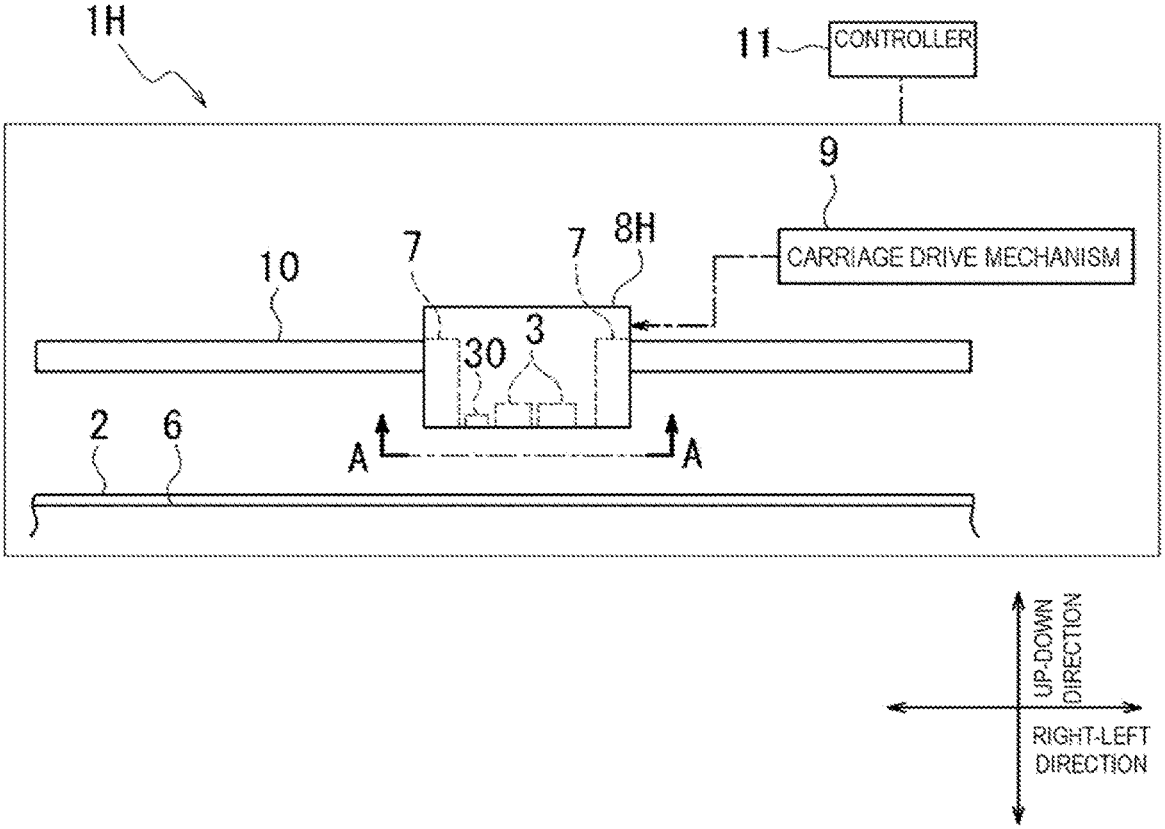
FIG. 11 is a view for explaining an inkjet printer according to an eighth modification.

FIG. 11 is a view for explaining an inkjet printer 1H according to the eighth modification.

Figure 12:
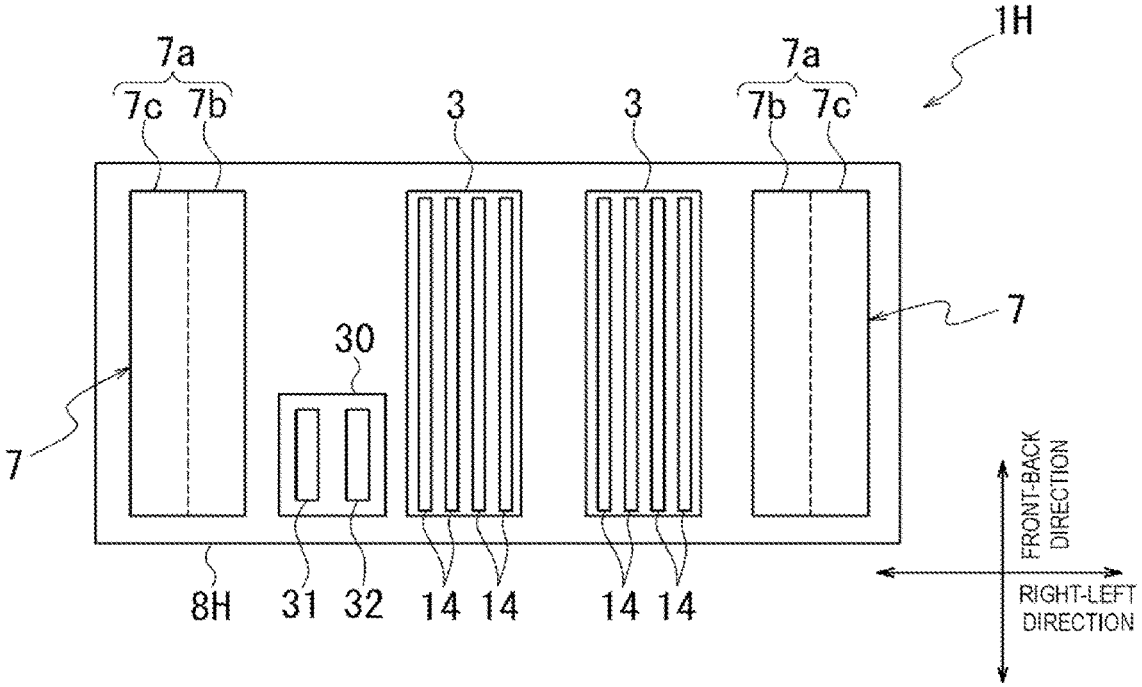
FIG. 12 is a view for explaining the inkjet printer according to the eighth modification.

FIG. 12 is a view of a carriage 8 in FIG. 11 as viewed from the direction of the arrow A-A.

Note that parts common to the inkjet printer 1 (see FIG. 1) according to the present embodiment will be described using the same reference signs.

A print medium 2 includes, for example, a printing paper, a fabric, and a resin film, and has different reflectance for reflecting ultraviolet depending on the material. As the material has higher reflectance, the ultraviolet irradiated from an ultraviolet irradiator 7 is more easily reflected on the print medium 2. Therefore, the amount of ultraviolet that becomes stray light increases. Then, stray light reaching the inkjet head 3 also increases, so that clogging of the nozzles of the inkjet head 3 is likely to occur.

As shown in FIGS. 11 and 12, the inkjet printer 1H (hereinafter, referred to as a "printer 1H".) according to the eighth modification further includes a reflectance detection mechanism 30 for measuring the width of the print medium 2 in the right-left direction and the reflectance of the print medium 2. The reflectance detection mechanism 30 is mounted on a carriage 8H together with an ultraviolet irradiator 7 and an inkjet head 3.

As shown in FIG. 12, the reflectance detection mechanism 30 is a reflective optical sensor including a light emitting section 31 and a light receiving section 32. The reflectance detection mechanism 30 is mounted on the carriage 8H.

As shown in FIG. 11, the reflectance detection mechanism 30 is mounted on the carriage 8H such that the light emitting surface of the light emitting section 31 and the light receiving surface of the light receiving section 32 face downward. The reflectance detection mechanism 30 is disposed between the inkjet head 3 and the ultraviolet irradiator 7 in the right-left direction. In the following explanation, the reflectance detection mechanism 30 is also referred to as an "optical sensor 30".

The light emitting section 31 and the light receiving section 32 of the optical sensor 30 are electrically connected to the controller 11. The light emitting section 31 emits visible light. The light receiving section 32 receives visible light emitted from the light emitting section 31 and reflected on a print medium 2 or a table 6.

The controller 11 reciprocates the carriage 8H in the right-left direction while emitting light from the light emitting section 31 prior to printing. The controller 11 reciprocates the carriage 8H in the right-left direction while emitting light from the light emitting section 31, and receives, by the light receiving section 32, the light reflected on the print medium 2. Based on the quantity of light received by the light receiving section 32, the controller 11 detects (measures) the reflectance of the print medium 2.

The controller 11 reciprocates the carriage 8H in the right-left direction while emitting light from the light emitting section 31, detects the both right and left end surfaces (specifies the positions of both end surfaces) of the print medium 2 based on the difference between the quantity of light received at the light receiving section 32 of the light reflected on the print medium 2 and the quantity of light received at the light receiving section 32 of the light reflected by the table 6, and detects (measures) the width in the right-left direction of the print medium 2 (hereinafter, simply referred to as a "width of the print medium 2".) based on the both right and left end surfaces of the print medium 2 having been detected.

Based on the reflectance of the print medium 2 and the width of the print medium 2 that have been detected, the controller 11 estimates the amount of ultraviolet that becomes stray light when ultraviolet is irradiated from a head position ultraviolet irradiation portion 7*a* of the ultraviolet irradiator 7.

Here, the controller 11 may estimate the amount of ultraviolet that becomes stray light based on only the detected reflectance of the print medium 2, but it is preferable to also take the width of the print medium 2 into consideration because the accuracy of the estimation becomes higher. This is because the irradiation time of ultraviolet when the carriage 8H moves in the main scanning direction is known by taking the width of the print medium 2 into consideration.

Here, when the ultraviolet that has become stray light and reached the inkjet head 3 reaches a predetermined cumulative light quantity, the ink in the nozzles is cured, and clogging occurs in the nozzles. Therefore, in order to suppress the clogging of the nozzles, it is necessary to reduce the cumulative light quantity of the ultraviolet reaching the inkjet head 3.

For this purpose, it is necessary to reduce the cumulative light quantity of the ultraviolet with which the head position ultraviolet irradiation portion 7*a* irradiates the print medium 2, which is the source, to reduce the cumulative light quantity of the ultraviolet reflected on the print medium 2.

In order to reduce the cumulative light quantity (product of the illuminance of ultraviolet and the irradiation time) of the ultraviolet with which the head position ultraviolet irradiation portion 7*a* irradiates the print medium 2, the following method is considered.

(i) Method of increasing the moving speed of the carriage 8H (reduce irradiation time. Illuminance is constant)

(ii) Method of reducing illuminance of ultraviolet (reduce illuminance. The moving speed (irradiation time) of the carriage 8H is constant)

(iii) Method using the above methods (i) and (ii) in combination (reduce both illuminance and irradiation time)

In the case of (i) above, it is conceivable to increase the feeding speed of a motor (not illustrated) included in the carriage drive mechanism 9.

In the case of (ii) above, the controller 11 controls the head position ultraviolet irradiation portion 7*a* to lower the effective voltage applied to the irradiation portion 7*b*, which is a part of the head position ultraviolet irradiation portion 7*a*. The effective voltage applied to the irradiation portion 7*c* is not lowered.

In the case of (iii) above, the effective voltage applied to the irradiation portion 7*b*, which is a part of the head position ultraviolet irradiation portion 7*a*, is lowered while the feeding speed of the motor included in the carriage drive mechanism 9 is increased.

Note that adjustment of the moving speed in the above (i) and the illuminance in the above (ii) is supposed to be automatically performed based on a value registered in advance in a CPU (not illustrated) included in the controller 11.

The controller 11 controls the printer 1H while maintaining the state in which the cumulative light quantity of ultraviolet is reduced by either of the methods (i) to (iii) above after the printing of one print medium 2 is started before the printing is finished.

Here, in the above cases (i) and (iii), there is a possibility that the resolution drops because the moving speed of the carriage 8H is increased. Therefore, another measure against the drop of resolution is necessary. On the other hand, in the case of (ii) above, since the moving speed of the carriage 8H is not increased, there is no possibility that the resolution drops. Therefore, the above (ii) is easier to take than the above (i) and (iii) because it does not require a measure against the drop of resolution.

Thus, in the printer 1H, the cumulative light quantity of the ultraviolet with which the head position ultraviolet irradiation portion 7*a* irradiates the print medium 2 during one reciprocating operation of the carriage 8H is adjustable according to the reflectance of the print medium 2 and the width in the right-left direction of the print medium 2.

(Effects)

As described above, using the optical sensor 30, the printer 1H according to the eighth modification detects the reflectance and the width of the print medium 2 before printing of the print medium 2. The controller 11 estimates the amount of ultraviolet that becomes stray light based on the detected reflectance and width of the print medium 2. Based on this estimation, the controller 11 adjusts the cumulative light quantity of the ultraviolet with which the head position ultraviolet irradiation portion 7*a* irradiates the print medium 2. For example, in a case where the reflectance of the print medium 2 is high and the amount of ultraviolet that becomes stray light is estimated to increase, by reducing the cumulative light quantity of the ultraviolet with which the head position ultraviolet irradiation portion 7*a* irradiates the print medium 2, the controller 11 can reduce the amount of ultraviolet that becomes stray light after being reflected on the print medium 2.

This can reduce the cumulative light quantity of ultraviolet reaching the inkjet head 3, and hence clogging of the nozzles of the inkjet head 3 can be suppressed.

By lowering the effective voltage applied to the irradiation portion 7*b* of the head position ultraviolet irradiation portion 7*a*, the controller 11 lowers the illuminance of the irradiation portion 7*b* closer to the inkjet head 3.

This reduces the cumulative light quantity of stray light reaching the nozzles of the inkjet head 3, as compared with that in the case of reducing the illuminance of the irradiation portion 7*c* farther from the inkjet head 3.

The inkjet printer 1H according to the eighth modification has the following configuration.

(17) The inkjet printer 1H includes:

the inkjet head 3 in which the plurality of nozzles that eject an ultraviolet-curable ink toward the print medium 2 are formed; the ultraviolet irradiator 7 that irradiates the print medium 2 with ultraviolet to cure ink ejected from the inkjet head 3 onto the print medium 2; the carriage 8H on which the inkjet head 3 and the ultraviolet irradiator 7 are mounted; and the carriage drive mechanism 9 that moves the carriage 8H in the right-left direction (main scanning direction).

The cumulative light quantity of the ultraviolet with which the head position ultraviolet irradiation portion 7*a* of the ultraviolet irradiator 7 irradiates the print medium 2 during one reciprocating operation of the carriage 8H is adjustable according to the reflectance of the print medium 2.

With this configuration, for example, when printing is performed on the print medium 2 having a high reflectance, by reducing the cumulative light quantity of the ultraviolet with which the head position ultraviolet irradiation portion 7*a* irradiates the print medium 2, it is possible to reduce the amount of ultraviolet that becomes stray light after being reflected on the print medium 2. Then, the cumulative light quantity of the ultraviolet reaching the inkjet head 3 is reduced, so that it is possible to suppress clogging of the nozzles of the inkjet head 3.

The inkjet printer 1H according to the eighth modification has the following configuration.

(18) The inkjet printer 1H includes the reflectance detection mechanism 30 for detecting the reflectance of the print medium 2 and the controller 11 that controls the inkjet printer 1H.

The controller 11 detects the reflectance of the print medium 2 using the reflectance detection mechanism 30 before printing of the print medium 2, and changes, based on the detected reflectance of the print medium 2, the cumulative light quantity of the ultraviolet with which the head position ultraviolet irradiation portion 7*a* irradiates the print medium 2 during one reciprocating operation of the carriage 8H.

With this configuration, it is possible to estimate the amount of ultraviolet that becomes stray light based on the detected reflectance, and to automatically adjust the cumulative light quantity of the ultraviolet with which the head position ultraviolet irradiation portion 7*a* irradiates the print medium 2.

The inkjet printer 1H according to the eighth modification has the following configuration.

(19) The reflectance detection mechanism 30 is an optical sensor that is configured to detect the width of the print medium 2 in the right-left direction.

The reflectance detection mechanism 30 is mounted on the carriage 8H.

The controller 11 detects the width in the right-left direction of the print medium 2 using the reflectance detection mechanism 30 before printing of the print medium 2, and changes, based on the width in the right-left direction of the print medium 2 and the reflectance of the print medium 2 that have been detected, the cumulative light quantity of the ultraviolet with which the ultraviolet irradiator 7 irradiates the print medium 2 during one reciprocating operation of the carriage 8H.

With this configuration, the irradiation time of ultraviolet when the carriage 8H moves in the main scanning direction is known. Therefore, the amount of ultraviolet that becomes stray light can be estimated with higher accuracy than that when estimated based on only the reflectance.

The inkjet printer 1H according to the eighth modification has the following configuration.

(20) By changing the illuminance of ultraviolet with which the head position ultraviolet irradiation portion 7*a* irradiates the print medium 2, the controller 11 changes the cumulative light quantity of the ultraviolet with which the head position ultraviolet irradiation portion 7*a* irradiates the print medium 2 during one reciprocating operation of the carriage 8H.

It is conceivable a method of changing the moving speed of the carriage 8H, for example, in order to change the cumulative light quantity of ultraviolet. However, the resolution changes when the moving speed of the carriage 8H is changed, and therefore measure against the change of resolution is necessary.

On the other hand, with the above configuration, it is possible to change the cumulative light quantity while avoiding the resolution from changing. The above configuration is easier because it does not require a measure against the change of resolution.

The inkjet printer 1H according to the eighth modification has the following configuration.

(21) The head position ultraviolet irradiation portion 7*a* is PWM-controlled.

The head position ultraviolet irradiation portion 7*a* and the inkjet head 3 are adjacent to each other in the right-left direction.

When the controller 11 lowers the illuminance of ultraviolet with which the print medium 2 is irradiated, the controller 11 lowers the effective voltage applied to the irradiation portion 7*b*, which is a part of the head position ultraviolet irradiation portion 7*a* on the inkjet head 3 side in the right-left direction, thereby lowering the illuminance of ultraviolet with which the print medium 2 is irradiated.

This configuration makes it possible to lower the illuminance of the irradiation portion 7*b* close to the inkjet head 3 of the head position ultraviolet irradiation portion 7*a*. This reduces the cumulative light quantity of ultraviolet reaching the inkjet head 3 as compared with that in the case of lowering the illuminance of the irradiation portion 7*c* far from the inkjet head 3.

It can also be specified as a control method of the inkjet printer 1H according to the eighth modification.

Specifically,

(23) The inkjet head 3 in which the plurality of nozzles that eject an ultraviolet-curable ink toward the print medium 2 are formed, the ultraviolet irradiator 7 that irradiates the print medium 2 with ultraviolet to cure ink ejected from the inkjet head 3 onto the print medium 2, the carriage 8H on which the inkjet head 3 and the ultraviolet irradiator 7 are mounted, the carriage drive mechanism 9 that moves the carriage 8H in the right-left direction (main scanning direction), and the reflectance detection mechanism 30 for detecting the reflectance of the print medium 2 are included.

The reflectance of the print medium 2 is detected using the reflectance detection mechanism 30 before printing of the print medium 2, and based on the detected reflectance of the print medium 2, the cumulative light quantity of the ultraviolet with which the ultraviolet irradiator 7 irradiates the print medium 2 during one reciprocating operation of the carriage 8H is changed.

With this configuration, it is possible to estimate the amount of ultraviolet that becomes stray light based on the detected reflectance, and to automatically adjust the cumulative light quantity of the ultraviolet with which the head position ultraviolet irradiation portion 7*a* irradiates the print medium 2.

(First Modification of Lighting Control of Ultraviolet Irradiator 7)

In the embodiment described above, the controller 11 may lower the effective voltage applied to the entire head position ultraviolet irradiation portion 7*a* (both irradiation portions 7*b* and 7*c*). In this case, the head ultraviolet irradiation portion 7*a* may not be divided into the two irradiation portions 7*b* and 7*c*.

The inkjet printer 1H according to the eighth modification has the following configuration.

The head position ultraviolet irradiation portion 7*a* is PWM-controlled.

The head position ultraviolet irradiation portion 7*a* and the inkjet head 3 are adjacent to each other in the right-left direction.

When lowering the illuminance of ultraviolet with which the print medium 2 is irradiated, the controller 11 changes the effective voltage applied to the entire head position ultraviolet irradiation portion 7*a*, thereby changing the illuminance of ultraviolet with which the print medium 2 is irradiated.

This configuration can reduce the cumulative light quantity of ultraviolet with which the print medium 2 is irradiated, and therefore can also reduce the cumulative light quantity of ultraviolet reflected from the print medium 2 and reaching the nozzles of the inkjet head 3.

(Second Modification of Lighting Control of Ultraviolet Irradiator 7)

The controller 11 may lower the effective voltage applied to the irradiation portion 7*c* when lowering the illuminance of ultraviolet with which the print medium 2 is irradiated.

(Third Modification of Lighting Control of Ultraviolet Irradiator 7)

By turning off a part of the head position ultraviolet irradiation portion 7*a*, the controller 11 may change the illuminance of ultraviolet with which the print medium 2 is irradiated. In this case, the controller 11 may turn off the irradiation portion 7*c*, but preferably turns off the irradiation portion 7*b*.

In a state where the irradiation portion 7*c* is turned on and the irradiation portion 7*b* is turned off, the interval in the right-left direction between the turned on part of the head position ultraviolet irradiation portion 7*a* and the inkjet head 3 becomes the interval between the irradiation portion 7*c* and the inkjet head 3. This interval is wider than the interval between the irradiation portion 7*b* and the inkjet head 3. Therefore, stray light becomes less likely to reach the nozzles of the inkjet head 3. Therefore, it becomes possible to effectively suppress clogging of the nozzles of the inkjet head 3 due to stray light.

The inkjet printer 1H according to the eighth modification has the following configuration.

(24) By turning off the irradiation portion 7*b*, which is a part of the head position ultraviolet irradiation portion 7*a*, the controller 11 lowers the illuminance of ultraviolet with which the print medium 2 is irradiated.

This configuration can change the cumulative light quantity of ultraviolet with which the print medium 2 is irradiated, and therefore can also change the cumulative light quantity of ultraviolet reflected from the print medium 2 and reaching the nozzles of the inkjet head 3.

The inkjet printer 1H according to the eighth modification has the following configuration.

(25) The head position ultraviolet irradiation portion 7*a* and the inkjet head 3 are adjacent to each other in the right-left direction.

When lowering the illuminance of ultraviolet with which the print medium 2 is irradiated, the controller 11 turns off the irradiation portion 7*b*, which is a part of the head position ultraviolet irradiation portion 7*a* on the inkjet head 3 side in the right-left direction.

With this configuration, in the head position ultraviolet irradiation portion 7*a*, only the irradiation portion 7*c* is turned on. Therefore, the interval between the turned on part of the head position ultraviolet irradiation portion 7*a* and the inkjet head 3 can be made wider than that when the irradiation portion 7*b* is turned on. Thus, stray light becomes less likely to reach the nozzles of the inkjet head 3. Therefore, it becomes possible to effectively suppress clogging of the nozzles of the inkjet head 3 due to stray light.

The current control may be performed on the head position ultraviolet irradiation portion 7*a*. The controller 11 may lower the current supplied to the irradiation portion 7*c* of the head position ultraviolet irradiation portion 7*a*, but preferably lowers the current supplied to the irradiation portion 7*b*. Furthermore, the controller 11 may lower the current supplied to the entire head position ultraviolet irradiation portion 7*a*.

(Modification of Reflectance Detection Mechanism 30)

In the embodiment described above, the case where the reflectance detection mechanism 30 is an optical sensor has been presented by way of example, but the present invention is not limited thereto. For example, the reflectance detection mechanism 30 may be an ultraviolet sensor.

The ultraviolet sensor can directly specify the amount of ultraviolet that becomes stray light by receiving ultraviolet reflected on the print medium 2.

Therefore, rather than the optical sensor that receives visible light and estimates the amount of ultraviolet that becomes stray light, the ultraviolet sensor can more accurately grasp the amount of ultraviolet that becomes stray light, and it is hence possible to optimize more the cumulative light quantity of ultraviolet irradiated from the ultraviolet irradiator 7.

The inkjet printer 1H according to the eighth modification has the following configuration.

(26) The reflectance detection mechanism 30 is an ultraviolet sensor that is configured to detect the width of the print medium 2 in the main scanning direction.

The reflectance detection mechanism 30 is mounted on the carriage 8H.

The controller 11 detects the width of the print medium 2 in the main scanning direction using the reflectance detection mechanism 30 before printing of the print medium 2, and changes, based on the detected width of the print medium 2 in the main scanning direction and the reflectance of the print medium 2, the cumulative light quantity of the ultraviolet with which the head position ultraviolet irradiation portion 7*a* irradiates the print medium 2 during one reciprocating operation of the carriage 8H.

With this configuration, as compared with the optical sensor that receives visible light and estimates the amount of ultraviolet that becomes stray light, the amount of ultraviolet that receives ultraviolet and becomes stray light can be directly specified, so that the amount of ultraviolet that becomes stray light can be grasped more accurately. Therefore, it is possible to optimize more the cumulative light quantity of ultraviolet irradiated from the ultraviolet irradiator 7.

In the embodiment described above, the reflectance detection mechanism 30 for detecting the reflectance of the print medium 2 and a width detection mechanism for detecting the width of the print medium 2 may be individually provided. In this case, the reflectance detection mechanism 30 may not be mounted on the carriage 8H.

Even in a case where the printer 1H does not include the reflectance detection mechanism 30, it is only required for the operator to be capable of manually adjusting the cumulative light quantity of the ultraviolet with which the head position ultraviolet irradiation portion 7*a* irradiates the print medium 2, based on the reflectance of the print medium 2 measured using another inspection device, for example.

For example, a plurality of ultraviolet irradiation modes corresponding to the reflectance of the print medium 2 are set in advance, and the operator selects and sets a predetermined ultraviolet irradiation mode according to the reflectance of the print medium 2 measured by another inspection device.

Furthermore, the operator may select and set a predetermined ultraviolet irradiation mode so that for example, when clogging of the nozzles of the inkjet head 3 occurs, the cumulative light quantity of the ultraviolet with which the head position ultraviolet irradiation portion 7*a* irradiates the print medium 2 during one reciprocating operation of the carriage 8H is reduced.

In the embodiment described above, the head position ultraviolet irradiation portion 7*a* may include three or more irradiation portions divided in the right-left direction. In the embodiment described above, the number of the ultraviolet irradiator 7 to be mounted on the carriages 8 and 8H may be one.

The cases where the printers 1 to 1H have the plurality of inkjet heads 3 to 3G have been presented by way of example, but the present invention is not limited thereto. The number of the inkjet heads 3 to 3G may be one. The cases where the present invention is the inkjet printers 1 to 1H that perform printing on a flat surface have been presented by way of example, but the present invention is not limited thereto. For example, the present invention may be a 3D printer that shapes a three-dimensional object.

OTHER EMBODIMENTS

Although the embodiment described above is an example of a preferred embodiment of the present invention, the present invention is not limited thereto, and various modifications can be made within the technical scope of the present invention.

The invention claimed is:

1. An inkjet printer, comprising:

an inkjet head, provided with a plurality of nozzles that eject an ink which is ultraviolet-curable;

an ultraviolet irradiator, configured to irradiate the ink ejected from the inkjet head with an ultraviolet to cure the ink;

a carriage on which the inkjet head and the ultraviolet irradiator are mounted;

a carriage drive mechanism, configured to move the carriage in a main scanning direction; and a controller, configured to control the ultraviolet irradiator, wherein the ultraviolet irradiator and the inkjet head are adjacent to each other in the main scanning direction, the ultraviolet irradiator is partitioned into a head-side irradiation portion and an outer side irradiation portion that are made lighting controllable, wherein the head-side irradiation portion is disposed on a side closer to the inkjet head in the main scanning direction, and the outer side irradiation portion is disposed on a side farther from the inkjet head in the main scanning direction, a predetermined moving speed of the carriage in the main scanning direction is a first moving speed, and a moving speed of the carriage in the main scanning direction slower than the first moving speed is a second moving speed, the controller is configured to:

turn on both of the head-side irradiation portion and the outer side irradiation portion when the carriage moves at the first moving speed, and turn off at least a part of the head-side irradiation portion when the carriage moves at the second moving speed.

2. The inkjet printer as set forth in claim 1, wherein the controller is configured to change a peak illuminance of ultraviolet with which the portion head-side irradiation portion irradiates the ink according to the moving speed of the carriage, so that a value obtained by dividing the peak illuminance of ultraviolet with which the head-side irradiation portion irradiates the ink by the moving speed of the carriage becomes constant.

3. The inkjet printer as set forth in claim 1, wherein the controller is configured to:

make a current supplied to a part of the head-side irradiation portion when the carriage moves at the second moving speed lower than a current supplied to a part of the head-side irradiation portion when the carriage moves at the first moving speed, or make a current supplied to an entirety of the head-side irradiation portion when the carriage moves at the second moving speed lower than a current supplied to an entirety of the head-side irradiation portion when the carriage moves at the first moving speed.

4. The inkjet printer as set forth in claim 3, wherein
the controller is configured to reduce a current supplied to a part of the head-side irradiation portion on the side closer to the inkjet head in the main scanning direction, when the carriage moves at the second moving speed.

5. The inkjet printer as set forth in claim 1, wherein
the ultraviolet irradiator is PWM-controlled, and
the controller is configured to:
make an effective voltage applied to a part of the head-side irradiation portion when the carriage moves at the second moving speed lower than an effective voltage applied to a part of the head-side irradiation portion when the carriage moves at the first moving speed, or
make an effective voltage applied to an entirety of the head-side irradiation portion when the carriage moves at the second moving speed lower than an effective voltage applied to an entirety of the head-side irradiation portion when the carriage moves at the first moving speed.

6. The inkjet printer as set forth in claim 5, wherein
the controller is configured to lower an effective voltage applied to a part of the head-side irradiation portion on the side closer to the inkjet head in the main scanning direction, when the carriage moves at the second moving speed.

7. An inkjet printer, comprising:
an inkjet head, provided with a plurality of nozzle rows that ejects an ink which is ultraviolet-curable;
an ultraviolet irradiator, configured to irradiate the ink ejected from the inkjet head with an ultraviolet to cure the ink;
a carriage on which the inkjet head and the ultraviolet irradiator are mounted; and
a carriage drive mechanism, configured to move the carriage in a main scanning direction,
wherein the inkjet head and the ultraviolet irradiator are adjacent to each other in the main scanning direction;
wherein the nozzle rows include a plurality of nozzles arranged in a sub scanning direction orthogonal to the main scanning direction and an up-down direction;
wherein the inkjet head includes:
a color ink nozzle row, being the nozzle row that ejects a color ink which is ultraviolet-curable,
a white ink nozzle row, being the nozzle row that ejects a white ink which is ultraviolet-curable, and
a clear ink nozzle row, being the nozzle row that ejects a clear ink which is ultraviolet-curable and transparent;
wherein the white ink nozzle row and the clear ink nozzle row are disposed at a same position in the sub scanning direction,
wherein the inkjet head includes:
a first inkjet head, provided with a plurality of the color ink nozzle rows; and
a second inkjet head, provided with the white ink nozzle row and the clear ink nozzle row,
the first inkjet head is disposed at a position shifted from the second inkjet head in the sub scanning direction, and the first inkjet head is disposed at a position shifted from the second inkjet head in the main scanning direction,
at least a space portion where the color ink nozzle row is disposed in the sub scanning direction or the white ink nozzle row is arranged between the clear ink nozzle row and the ultraviolet irradiator in the main scanning direction.

8. The inkjet printer as set forth in claim 7, wherein
the ultraviolet irradiator is arranged on each of both sides of the inkjet head in the main scanning direction.

9. The inkjet printer as set forth in claim 8, wherein
the white ink nozzle row and the clear ink nozzle row are arranged adjacent to each other in the main scanning direction, and
the color ink nozzle row is arranged on each of both sides in the main scanning direction of the white ink nozzle row and the clear ink nozzle row.

10. An inkjet printer, comprising:
an inkjet head, provided with a plurality of nozzle rows that ejects an ink which is ultraviolet-curable;
an ultraviolet irradiator, configured to irradiate the ink ejected from the inkjet head with an ultraviolet to cure the ink;
a carriage on which the inkjet head and the ultraviolet irradiator are mounted; and
a carriage drive mechanism, configured to move the carriage in a main scanning direction,
wherein the ultraviolet irradiator is arranged on each of both sides of the inkjet head in the main scanning direction;
wherein the nozzle rows include a plurality of nozzles arranged in a sub scanning direction orthogonal to the main scanning direction and an up-down direction;
wherein the inkjet head includes:
a color ink nozzle row, being the nozzle row that ejects a color ink which is ultraviolet-curable,
a white ink nozzle row, being the nozzle row that ejects a white ink which is ultraviolet-curable, and
a clear ink nozzle row, being the nozzle row that ejects a clear ink which is ultraviolet-curable and transparent, and
wherein the white ink nozzle row and the clear ink nozzle row are disposed at a same position in the sub scanning direction,
wherein the inkjet head includes:
a first inkjet head, provided with a plurality of the color ink nozzle rows; and
a second inkjet head, provided with the white ink nozzle row and the clear ink nozzle row,
the first inkjet head is disposed at a position shifted from the second inkjet head in the sub scanning direction, and the first inkjet head is disposed at a position shifted from the second inkjet head in the main scanning direction,
at least the color ink nozzle row is arranged between the clear ink nozzle row and the ultraviolet irradiator in the main scanning direction.

11. The inkjet printer as set forth in claim 10, wherein
the white ink nozzle row and the clear ink nozzle row are arranged adjacent to each other in the main scanning direction, and
the color ink nozzle row is arranged on each of both sides in the main scanning direction of the white ink nozzle row and the clear ink nozzle row.

* * * * *